US009224526B1

(12) United States Patent
Nagarathnam et al.

(10) Patent No.: US 9,224,526 B1
(45) Date of Patent: Dec. 29, 2015

(54) MAGNET CONSTRUCTION BY COMBUSTION DRIVEN HIGH COMPACTION

(75) Inventors: Karthik Nagarathnam, Culpeper, VA (US); Dennis W. Massey, Manassas, VA (US)

(73) Assignee: Utron Kinetics, LLC, Manassas, VA (US)

( * ) Notice: Subject to any disclaimer, the term of this patent is extended or adjusted under 35 U.S.C. 154(b) by 209 days.

(21) Appl. No.: 13/114,716

(22) Filed: May 24, 2011

Related U.S. Application Data

(60) Provisional application No. 61/396,231, filed on May 24, 2010.

(51) Int. Cl.
*H01F 1/032* (2006.01)
*H01F 1/055* (2006.01)

(52) U.S. Cl.
CPC ..... *H01F 1/0555* (2013.01); *H01F 1/032* (2013.01)

(58) Field of Classification Search
CPC ..... H01F 1/0576; H01F 1/04; H01F 1/032
USPC ..... 148/101
See application file for complete search history.

(56) References Cited

U.S. PATENT DOCUMENTS

| | | | | |
|---|---|---|---|---|
| 4,558,077 | A * | 12/1985 | Gray | 252/62.54 |
| 4,832,891 | A * | 5/1989 | Kass | 252/62.54 |
| 5,643,491 | A * | 7/1997 | Honkura et al. | 252/62.54 |
| 6,554,913 | B2 * | 4/2003 | Arai et al. | 148/101 |
| 6,767,505 | B2 | 7/2004 | Witherspoon et al. | |

OTHER PUBLICATIONS

Karthik Nagarathnam, Donald Trostle, Dave Kruczynski, and Deniis Massey, Materials Behavior and Manufacturing Aspects of High Pressure Combustion Driven Compaction P/M Components, Paper Presented at the 2004 International Conference on Powder Metallurgy & Particulate Materials (PM2TEC-2004), held in Chicago, IL., Jun. 13-17, 2004, Part 9, pp. 1-15.

Karthik Nagarathnam, Aaron Renner, Donald Trostle, David Kruczynski, and Dennis Massy, Development of 1000-ton Combustion Driven Compaction Press for Materials Development and Processing, Paper Presented and Published in the Conference Proceedings at the 2007 MPIF/APMI International Conference on Powder Metallurgy & Particulate Materials (PowderMet2007), held in Denver, Colorado, May 13-16, 2007, published by Metal Powder Industries Federation, Princeton, NY, Part 3, pp. 19-33.

Karthik Nagarathnam, Ceramic Defense: Pressing with Controlled Combustion, Published in Ceramic Industry, by BNP media, Jun. 1, 2006. (Electronic Version of the Publication Published in the following link: http://www.ceramicindustry.com/CDA/Articles/Feature_Article/10cd85375737b010).

Dennis Massey, Combustion Driven Compaction Automation: A Pressing Solution for Niche Markets, 2008 World Congress on Powder Metallurgy & Particulate Materials, Part 3, pp. 139-142.

Karthik Nagarathnam, Donald Trostle and Dennis Massey, Process Optimization and Properties of Select Non-Ferrous Materials Using High Pressure Combustion Driven Powder Compaction, Published in the Proc. Seventh Int. Conf. on Tungsten, Refractory and Hardmaterials VIII, Published by Metal Powder Industries Federation, 2008, pp. 3-92 to 3-106.

Dennis Massey and Karthik Nagarathnam, Combustion Driven Compaction, SMMA Conference UTRON Kinetics Presentation, Slides 1-19, Chicago, 2009.

Yuwen Zhao, Chaoying Ni, David Kruczynski, Xiaokai Zhang, and John Q Xiao, Exchange-Coupled Soft Magnetic FeNi—SiO2 Nanocomposite, Published in the Journal of Physical Chemistry, vol. 108, No. 12, 2004. (University of Delaware Collaboration, U.S. DARPA Project through the Air Force Research Lab (Under Grant # F33615-01-2-2166).

Sara Majetich, Coercivity of Magnetic Nanoparticles and Nanocomposites, Carnegie Mellon University, MURI Projects and NSF Project, Under Contract # DMR-9900550.

G.S. Upadhyaya, Sintered Metallic and Ceramic Materials, Chapter 10 on Sintered Rare Earth Intermetallics, John Wiley & Sons Ltd, 2000, pp. 483-495.

Leander F. Pease and William G. West, Fundamentals of Powder Metallurgy, Metal Powder Industry Federation, 2002, pp. 1-452.

Standard Specifications for Permanent Magnet Materials, Magnet Materials Producers Association, Chicago, Illinois, MMPA Standard No. 0100-00.

John Ormerod and Steve Constantinides, Bonded permanent magnets: Current status and future opportunities, J. Appl. Phys. 81, 4816 (1997); doi: 10.1063/1.365471 (5 pages).

http://www.themagnetguide.com/bonded-ndfeb-magnets.html.

http://www.mqitechnology.com/downloads/articles/AutomotiveAccessoryMotors.pdf.

http://www.mqitechnology.com/downloads/brochures_PDF/MQP-Product-Specification.pdf and Patents Related to Magnaquench Powders.

Handbook of Advanced Materials, James K. Wessel (Editor), Wiley InterScience, 2004, pp. 1-645.

ASM Metals Handbook, Special Purpose Materials, 1998, pp. 639-650.

ASM Ready Reference, Electrical and magnetic Properties of Metals, 2000, pp. 1-285.

(Continued)

*Primary Examiner* — Jessee Roe
(74) *Attorney, Agent, or Firm* — James Creighton Wray; Meera P. Narasimhan

(57) ABSTRACT

A neo magnet is constructed by mixing a neo magnet powder with about 1% added two-part electrical insulating resin powder. The mixed powders are placed in a die and precompacted under about 20 tsi when filling a combustion chamber with a pressurized combustible gas and air mixture. The gas is ignited and rapidly drives a punch in to the die forming a solid magnet having a density of 6.1 g/cm$^3$ or more. The solid magnet is heat treated to cure the resin and is coated with a polymer, zinc, aluminum or gold. Before precompacting a lubricated core rod in place in the die producing a thin-walled, neo ring magnet having a length to wall thickness aspect ratio.

3 Claims, 39 Drawing Sheets

(56) References Cited

OTHER PUBLICATIONS

K.J. Stmat, Soft and Hard Magnetic Materials with Applications, ASM International, 1986, p. 64.

William F. Smith, Principles of Materials Science and Engineering, McGraw-Hill, Inc., 1986, pp. 1-892.

* cited by examiner

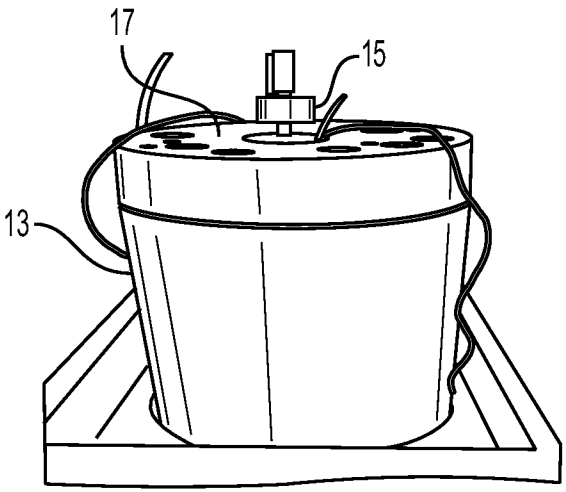
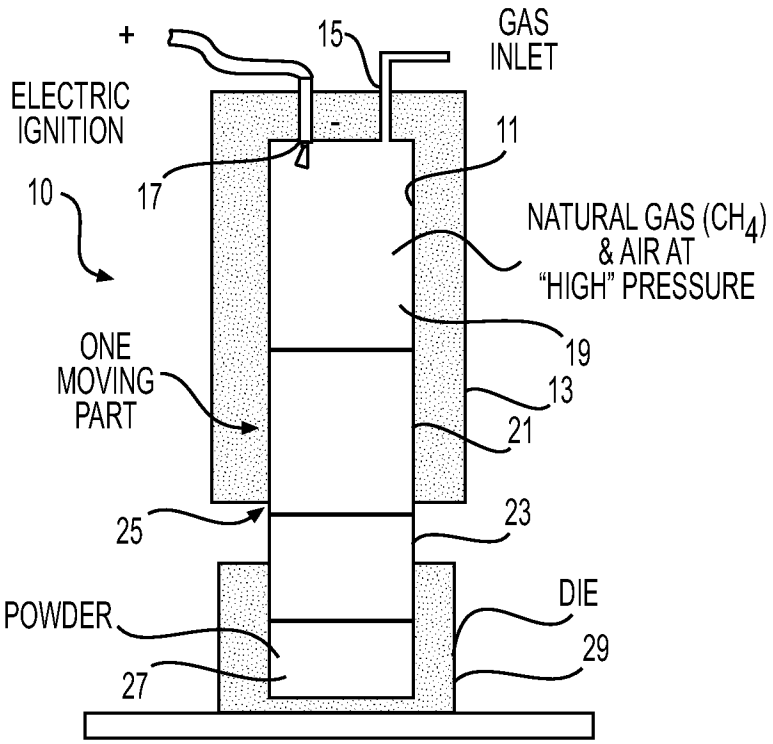
FIG. 1

- Fill gas creates pre-load pushing the piston or ram down, pre-compressing and removing entrapped air from the powder.
- An ignition stimulus is applied causing combustion and rapid pressure rise, further compressing the metal powder to its final net shape.

*The process although fast and powerful, is smooth and continuous*

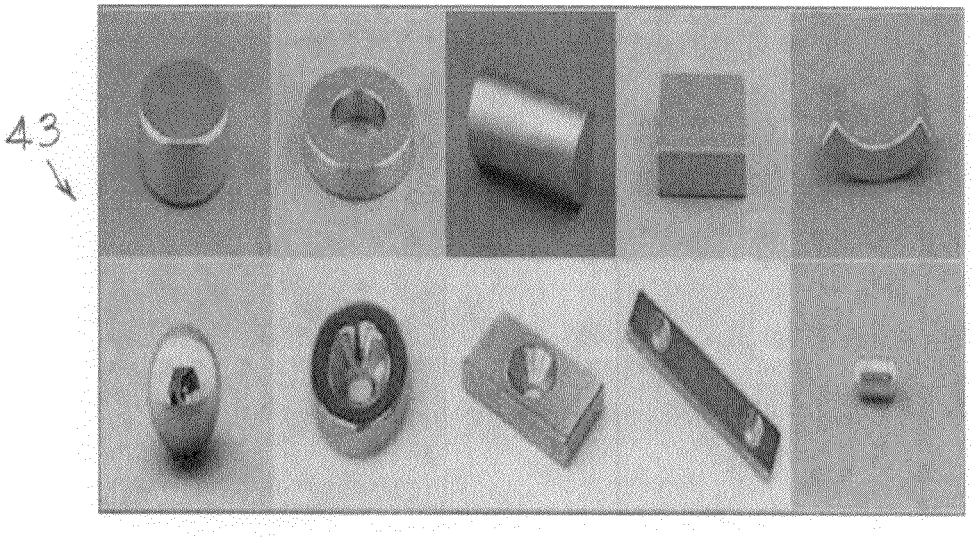
Figure 3b. Commonly Fabricated Permanent Magnet Geometries as Examples Including Thick Walled Ring Shapes with Height/Wall Thickness Aspect Ratios (typically <4 to 5)

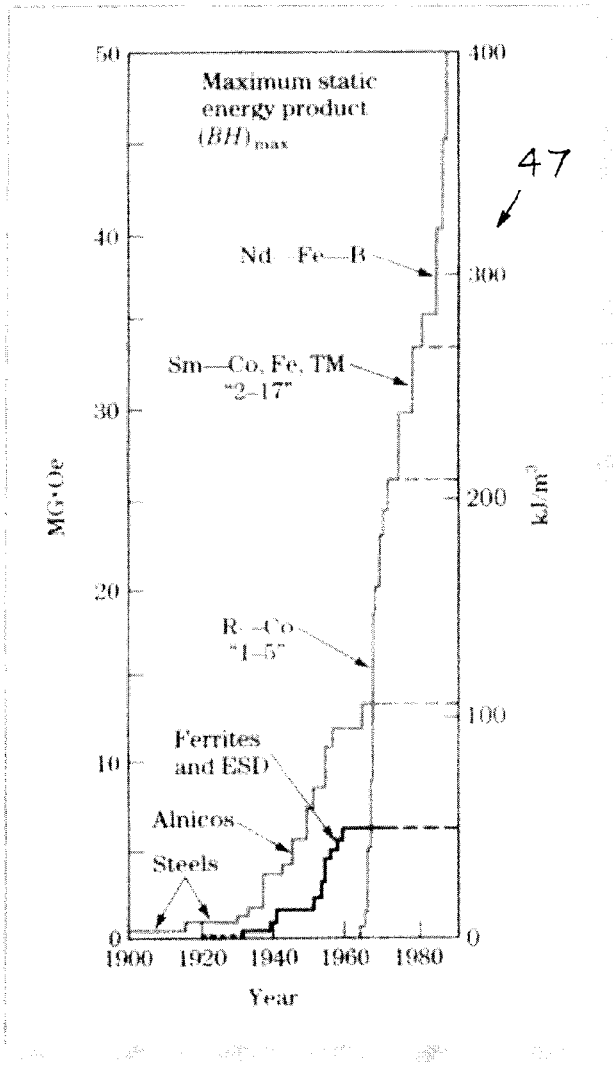
Figure 3c. Significance of Various Magnetic Materials for Improving BHmax (maximum magnetic energy product) Development

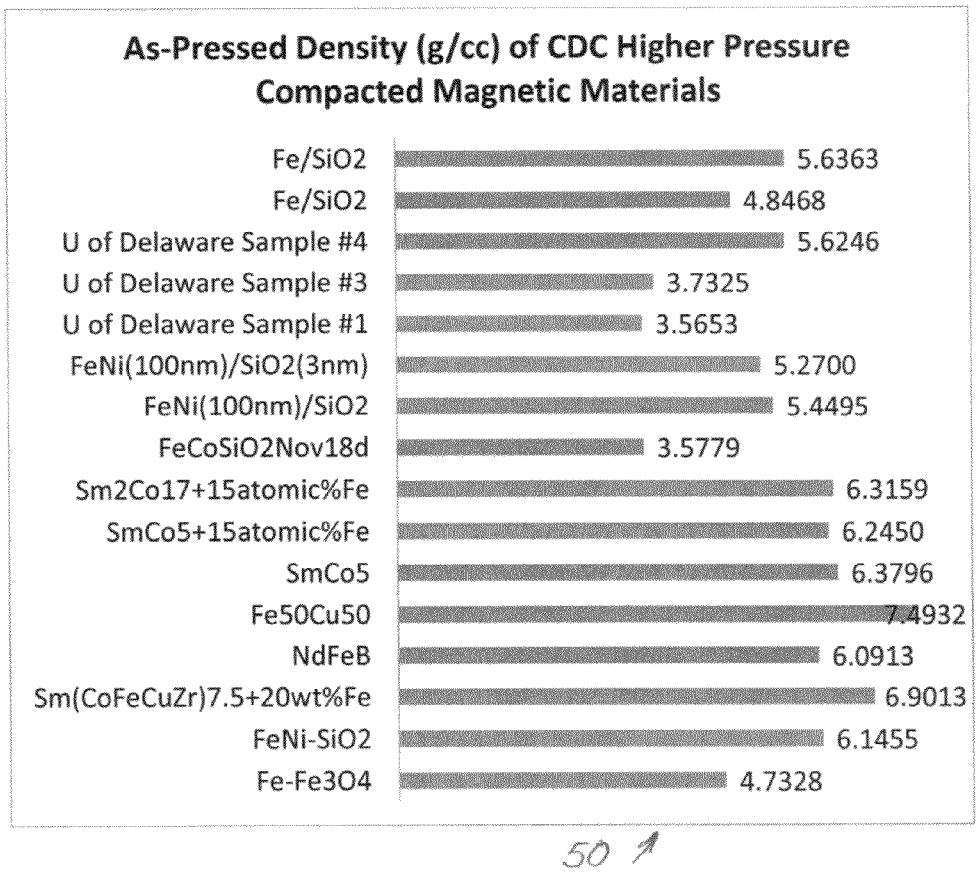
Figure 4a. As-Pressed Green Densities of CDC High Pressure Compacted Samples of Broad Spectrum of Magnetic Powders

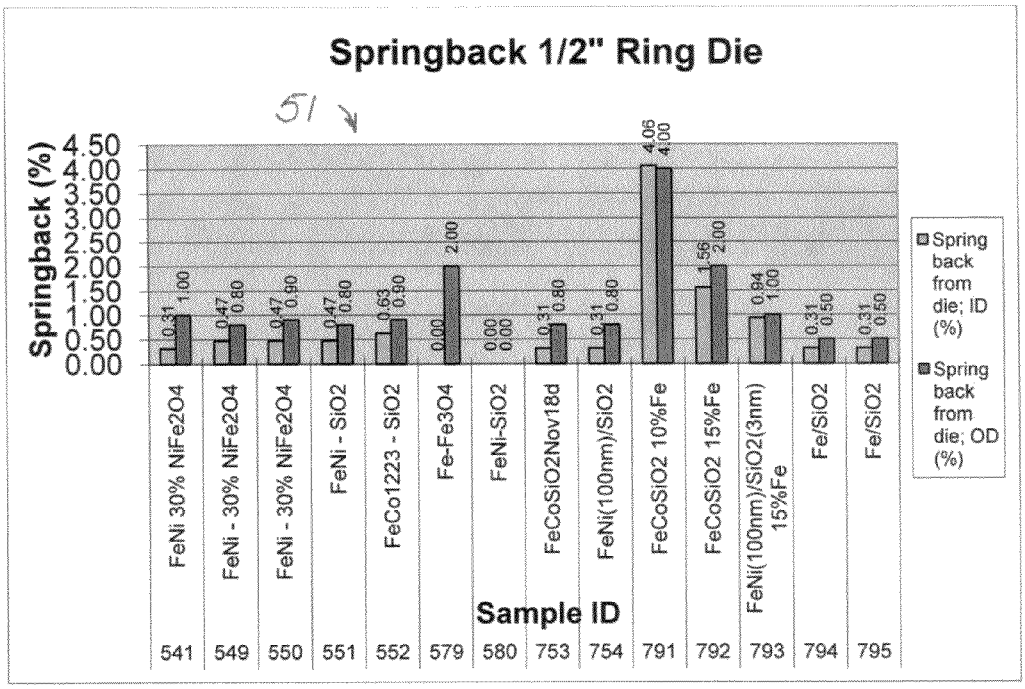
Figure 4b. % Springback of CDC high pressure compacted magnetic materials

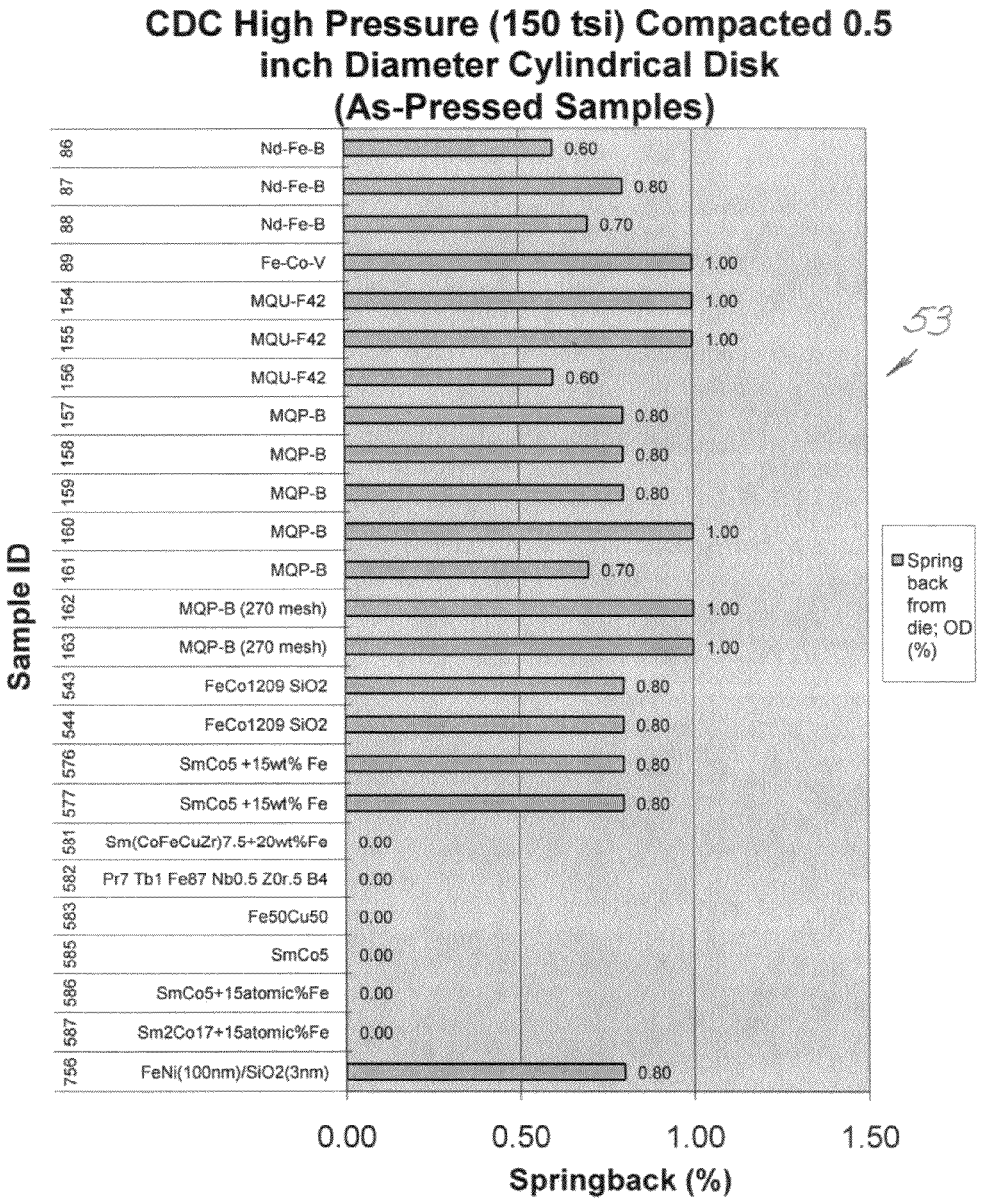
Fig. 4c. % Springback of As-Pressed CDC Magnetic Cylindrical Disk Samples

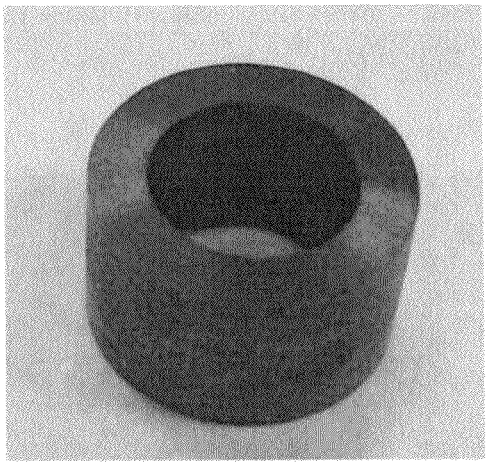
Figure 4d. CDC High Pressure Compacted Sample # 549
(FeNi - 30% $NiFe_2O_4$)
Aspect Ratio (part height/wall thickness): 3.21
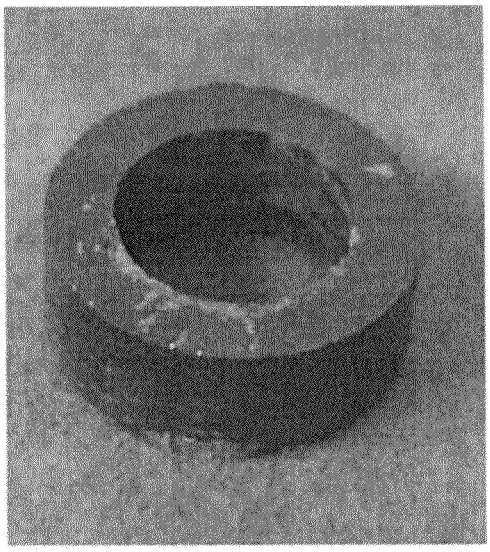
Figure 4e. Sample # 792
($FeCoSiO_2$ 15%Fe)
Aspect Ratio: 2.18

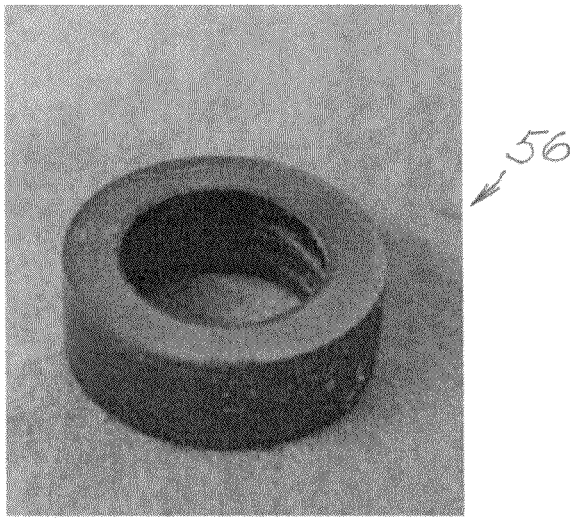
Figure 4f. Sample # 793
(FeNi(100nm)/$SiO_2$(3nm) 15%Fe)
Aspect Ratio: 1.99
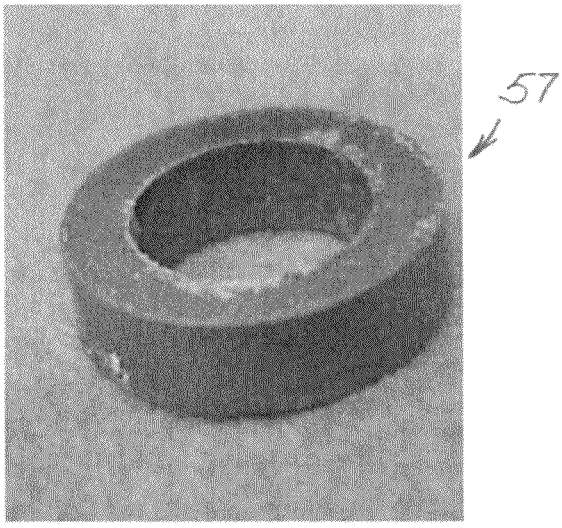
Fig. 4g Sample # 794
(Fe/$SiO_2$)
Aspect Ratio: 1.53

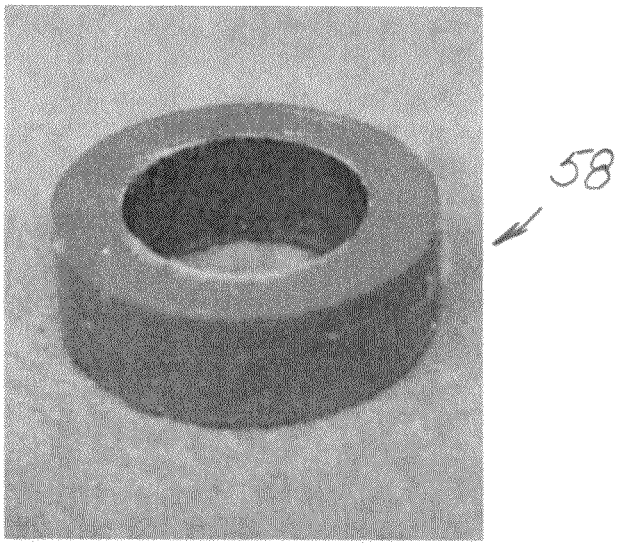
Figure 4h. Sample # 795
($Fe/SiO_2$)
Aspect Ratio: 1.82

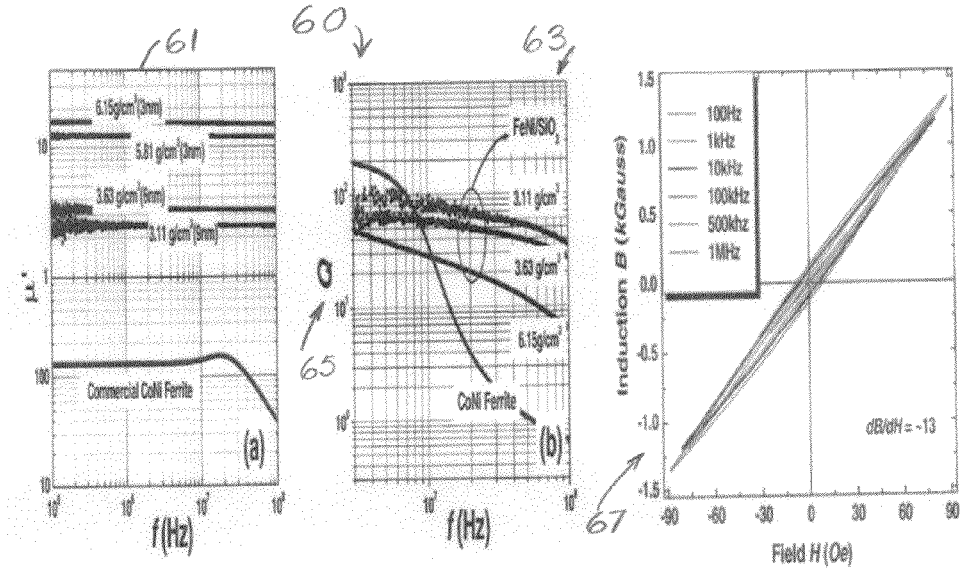

(a) (b)

Figure 5a. Significant Improvement of Permeability and Q-factor in UTRON Compacted CDC nanocomposite soft magnetic Fe-Ni with 3nm SiO2 powders with Higher Part Densities of 5.81 to 6.15 compared to the properties of traditional CoNi-Ferrite Materials; Fig. 5b Dynamic Hysteresis Loops of CDC compacted Soft Magnetic Nanocomposite Materials Up to 1 MHz for $FeNi/SiO_2$ with density of 5.81 g/cc of the same materials with small eddy current losses in the frequency ranges.

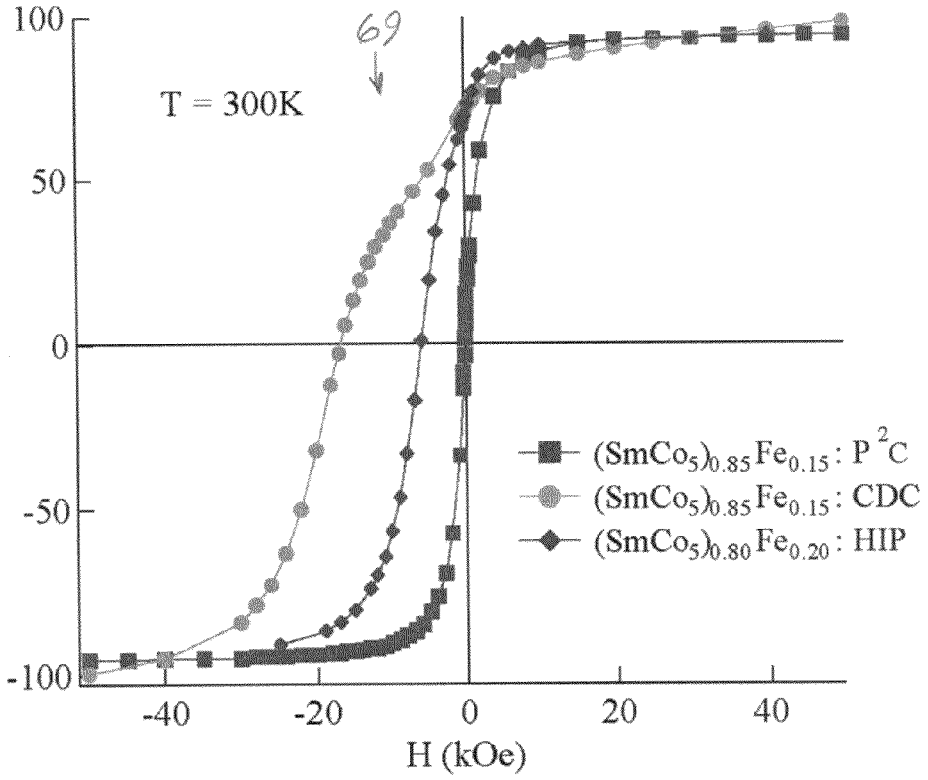
Figure 6. Improved BHmax Properties of CDC Higher Pressure Compacted High Temperature Permanent Magnetic Materials of SmCo/Fe composites. (CMU Research Project Publication) CDC-Combustion Driven Compaction; P2C-Plasma Pressure Compaction; HIP: Hot Isostatic Pressing Die Geometry; 0.575" OD Cylinder die
71
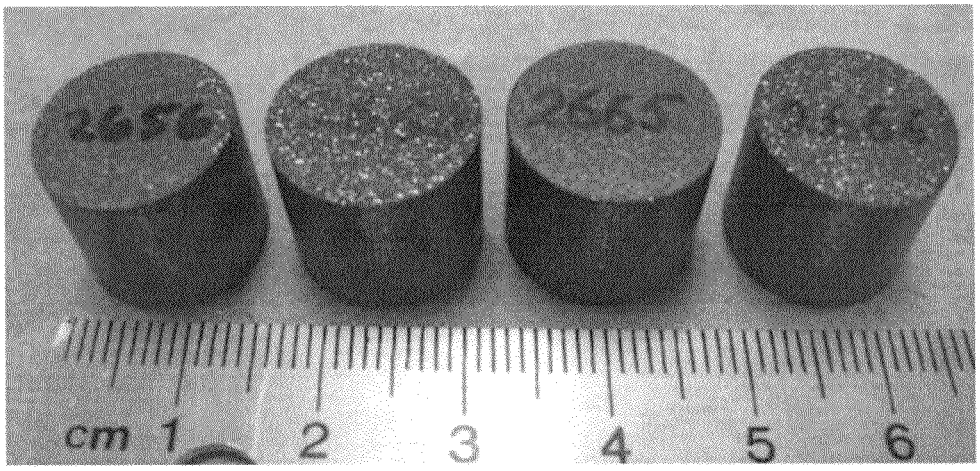
Figure 7. CDC High Pressure Compacted and Thermally Cured Sample# 2656, 2664, 2665, 2666;
73
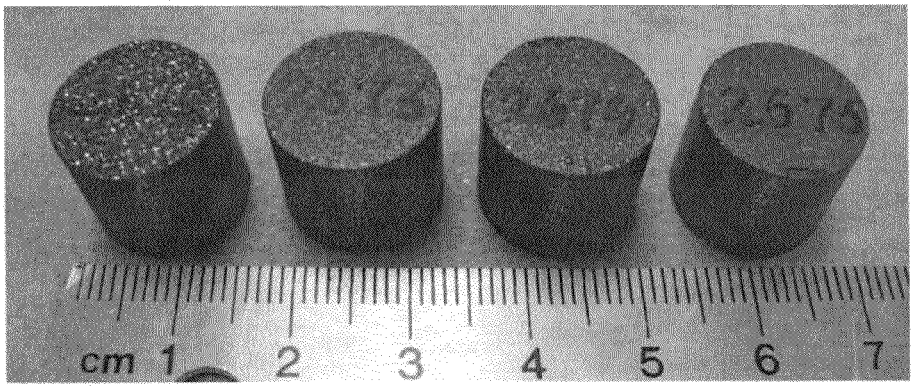
Figure 8. CDC Low Pressure Compacted and Thermally Cured Sample# 2672, 2673, 2674, 2675

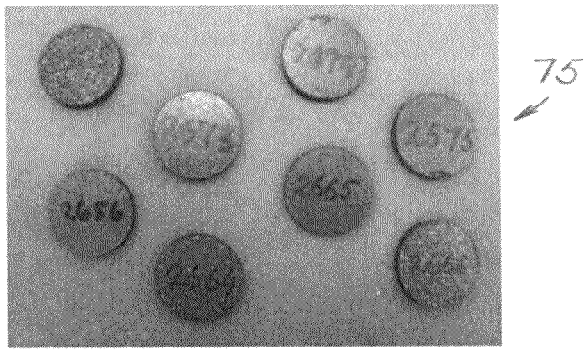
Figure 9. CDC Compacted and Thermally Cured Samples # 2672, 2673, 2674, 2675, #2656, #2664, #2665, #2666 (Samples Shipped by Fedex on 12-18-2009 for Magnetic Property Evaluation with Magnequench International)

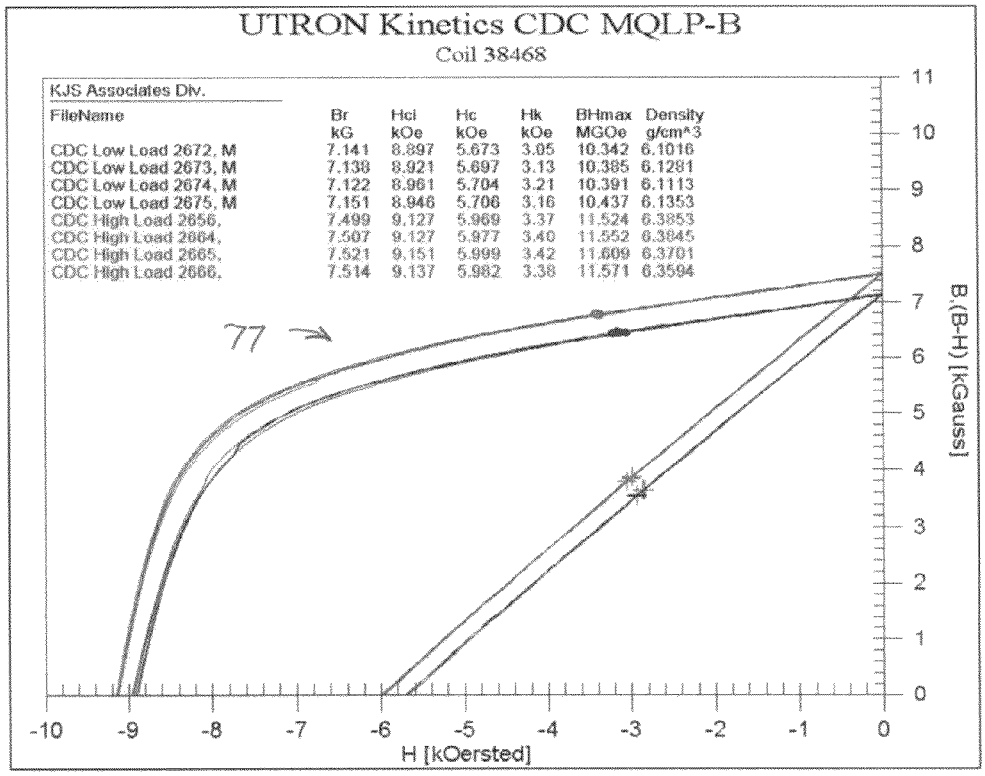
Figure 10. Higher CDC compaction pressure samples have overall better magnetic properties and density than lower CDC compaction pressure samples. There is ~0.2 kOe Hci difference in between higher and lower CDC compaction pressure samples, and this have been verified by 2 sets of coil).

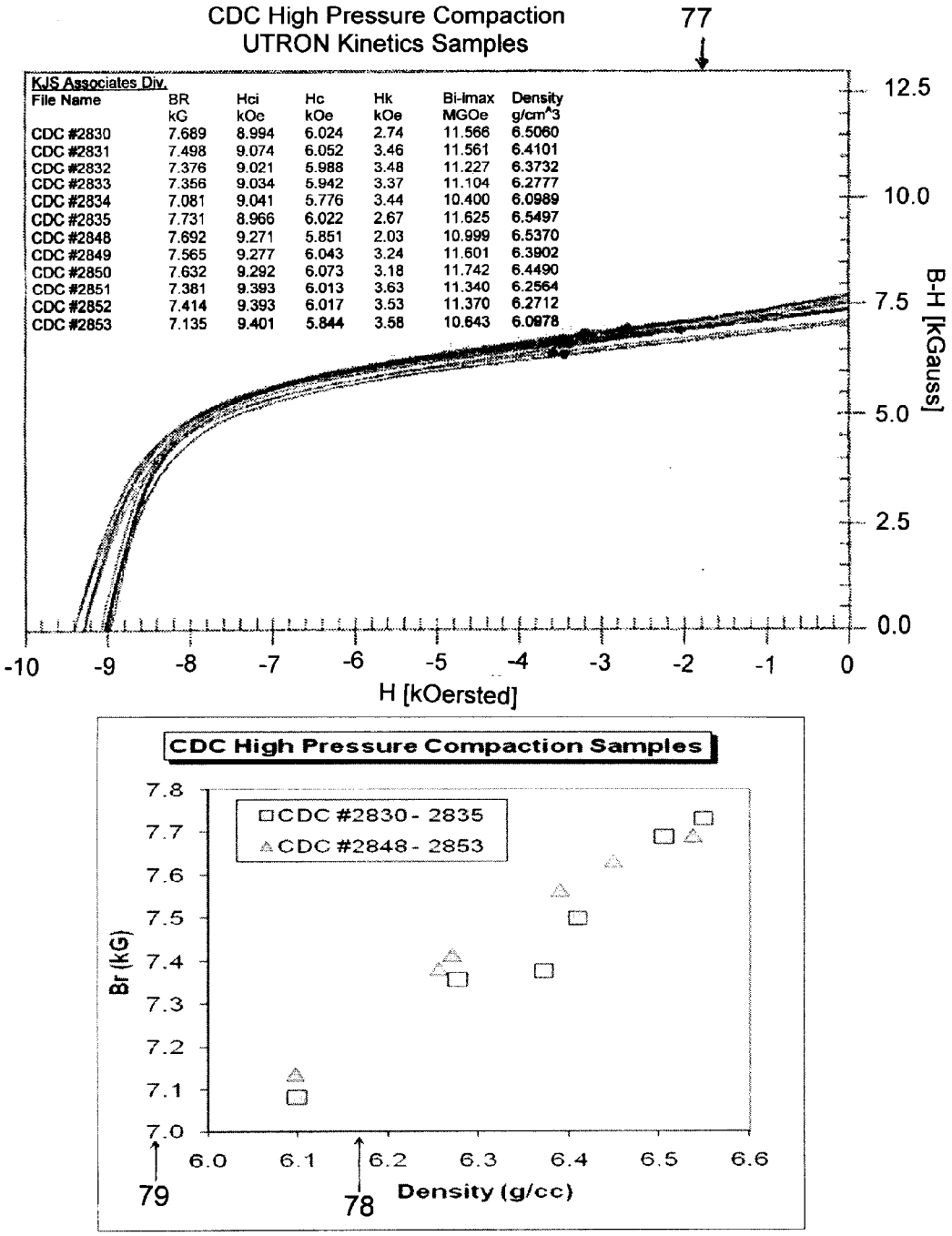
Figure 11. Magnetic Properties of UTRON Kinetic's Higher Performance Bonded Neo Magnets (HPM Series); 8b. Effects of CDC Higher Pressure Compaction to Improved Densification with Higher Remnance (Br).

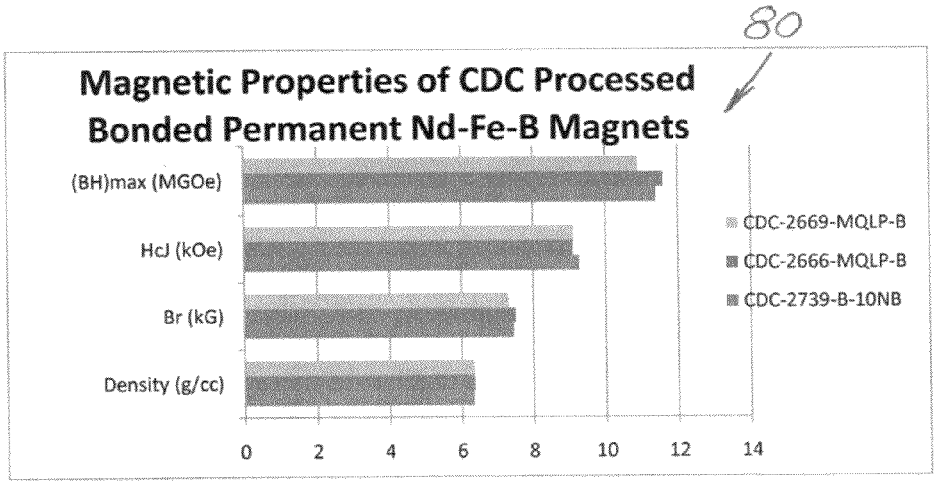
Figure 12. Select Magnetic Properties of CDC Compacted Bonded Neo Magnets

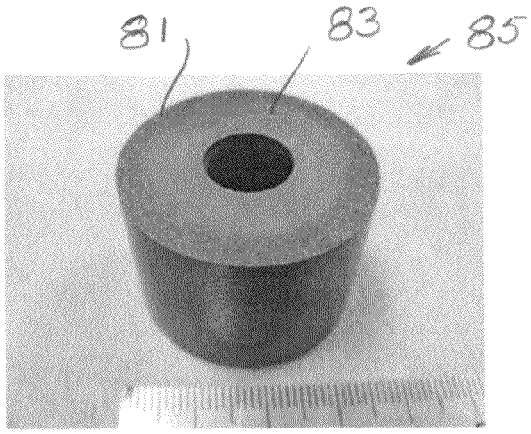
Figure 13. CDC Higher Pressure Compacted and Processed Magnetic Outer Ring/Steel Core Assembly for Potential Electric Motor Drive Applications

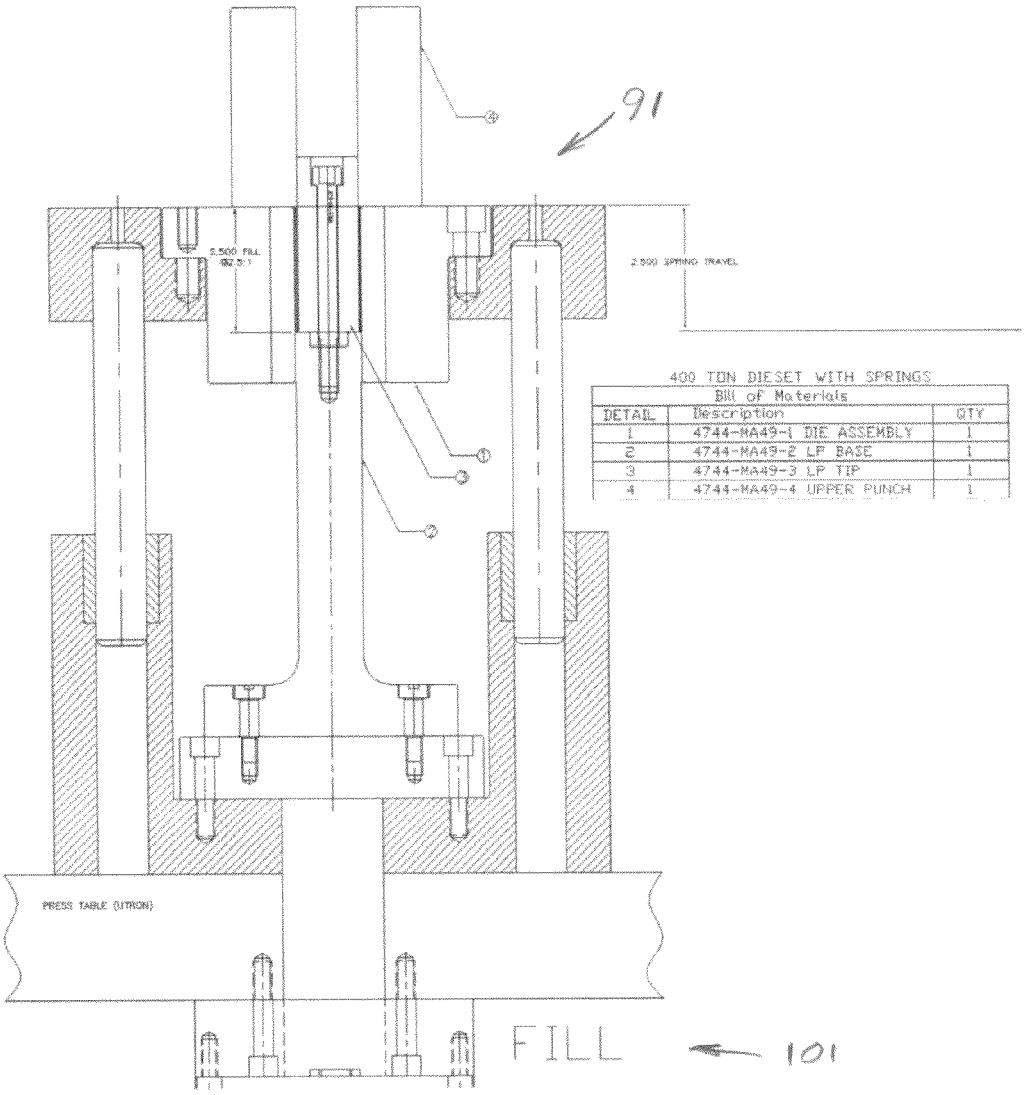
Figure 14. Powder Fill Position for Thin Walled Magnet Fabrication

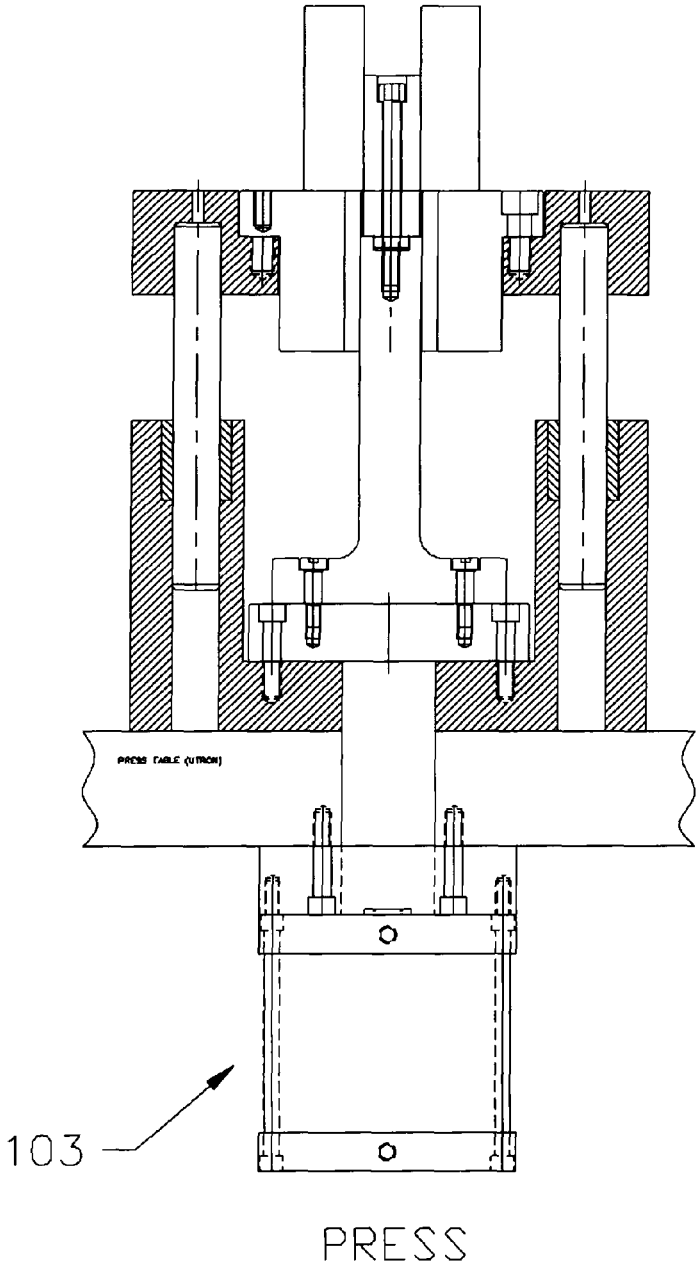
Figure 15. Powder Pressing Position to Fabricate the Thin Walled Net Shape CDC Magnet

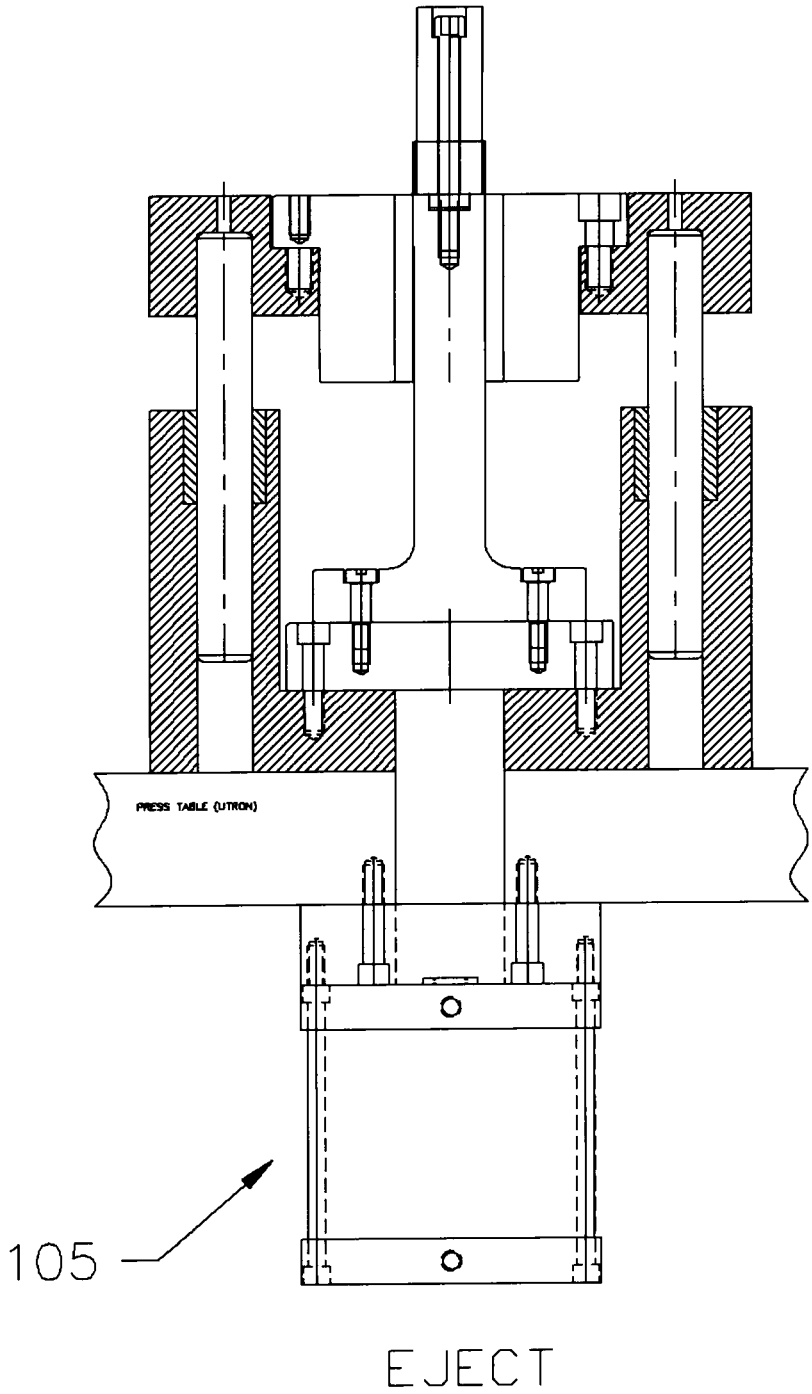
Figure 16. CDC Higher Pressure Compacted Net Shape Magnet Part Ejection

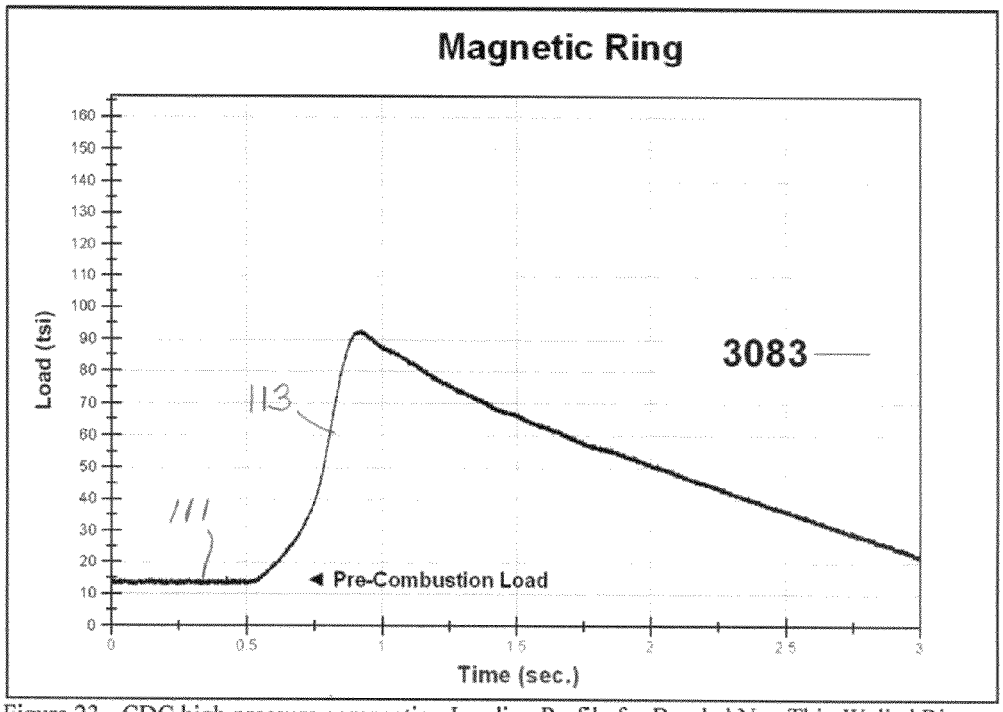
Figure 23. CDC high pressure compaction Loading Profile for Bonded Neo Thin Walled Ring (~95 tsi)

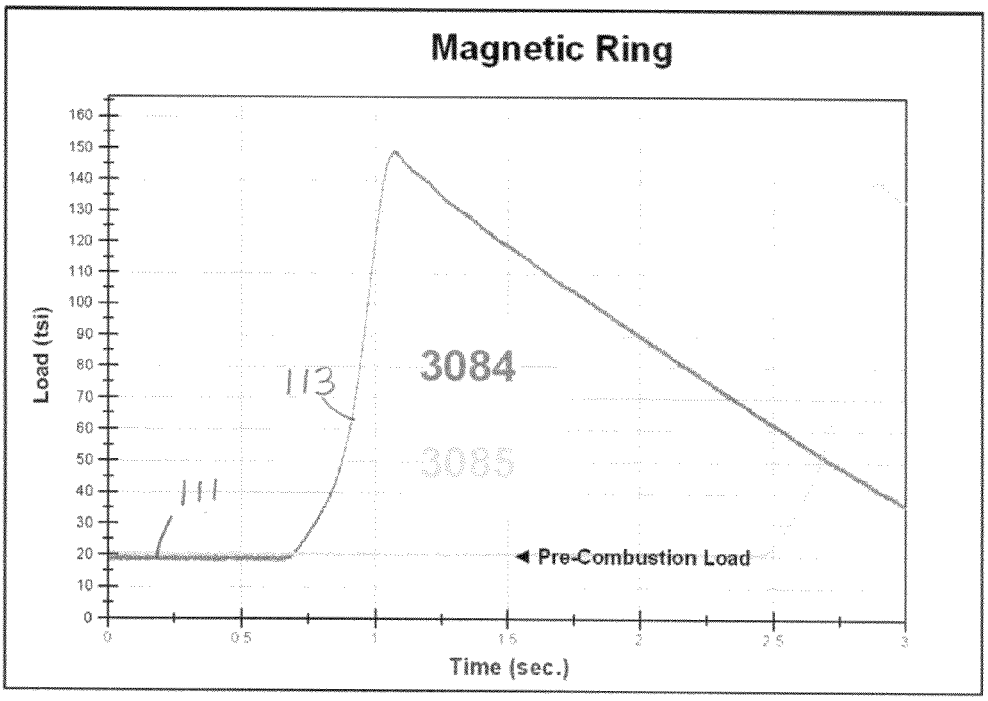
Figure 24a. CDC high pressure compaction Loading Profile for Bonded Neo Thin Walled Ring (~140-150 tsi)

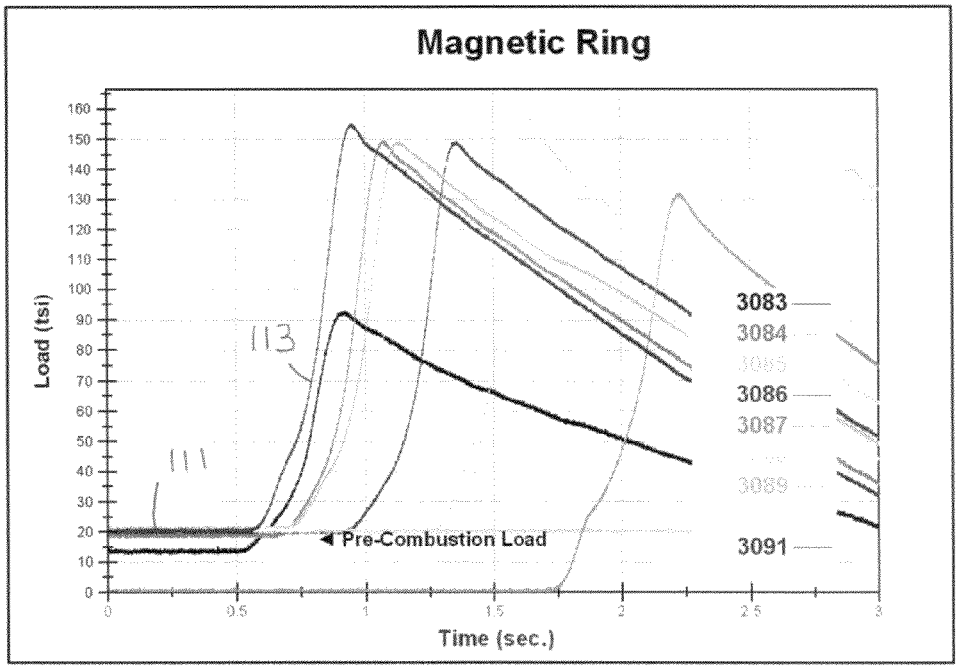
Figure 24b. CDC high pressure compaction Loading Profile for Bonded Neo Thin Walled Ring (~140-150 tsi)

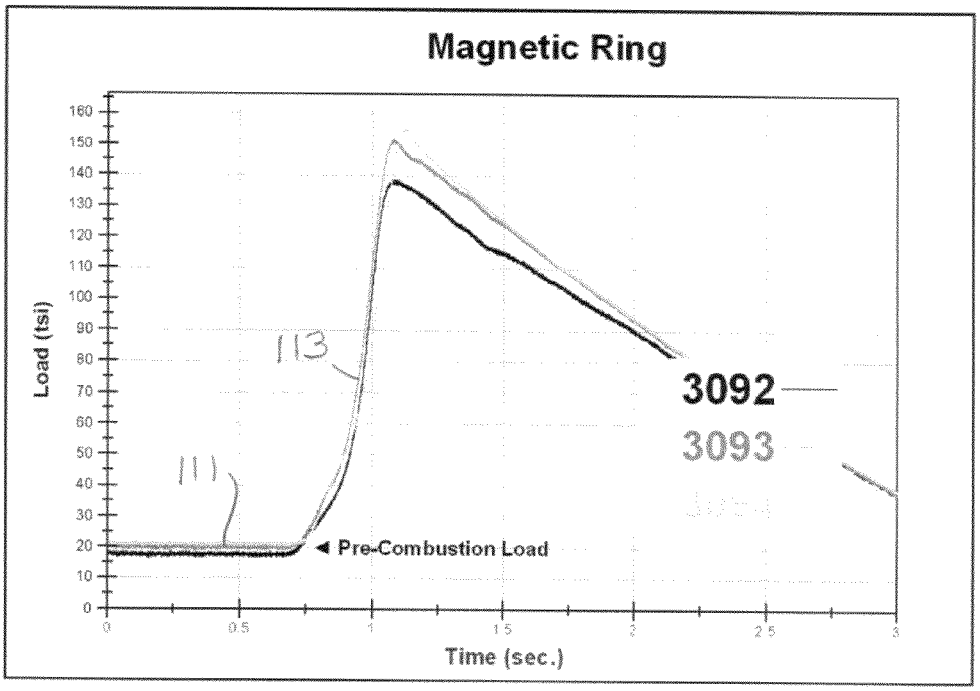
Figure 24c. CDC high pressure compaction Loading Profile for Bonded Neo Thin Walled Ring (~140-150 tsi)

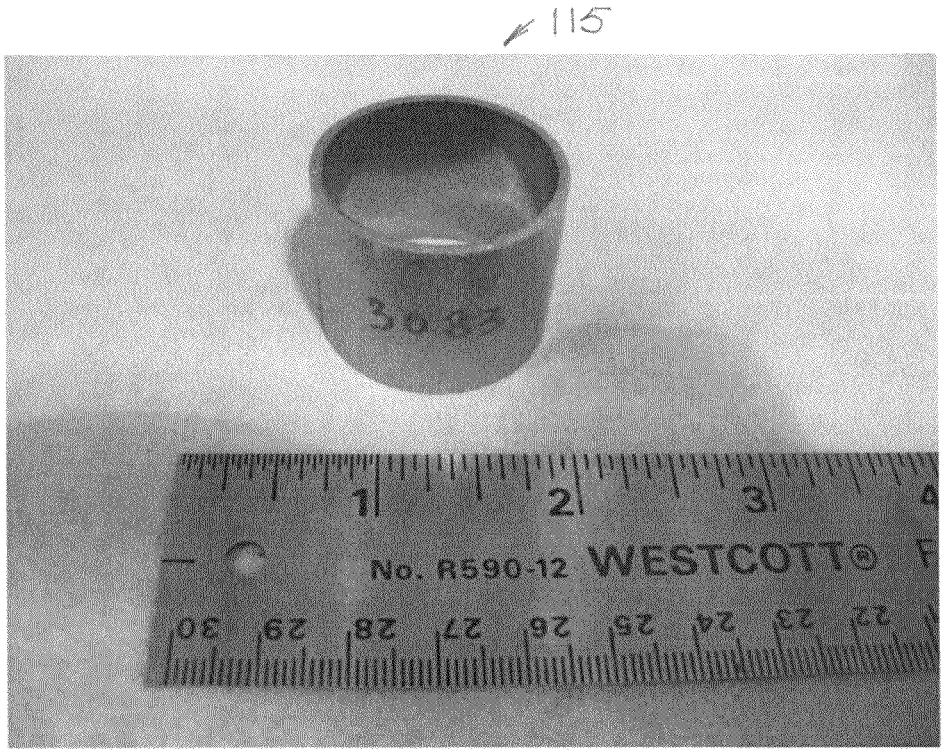
Figure 25. View of the CDC high pressure compacted Bonded Neo Thin Walled Ring at 95 tsi After the Part Removal from the Core Rod.

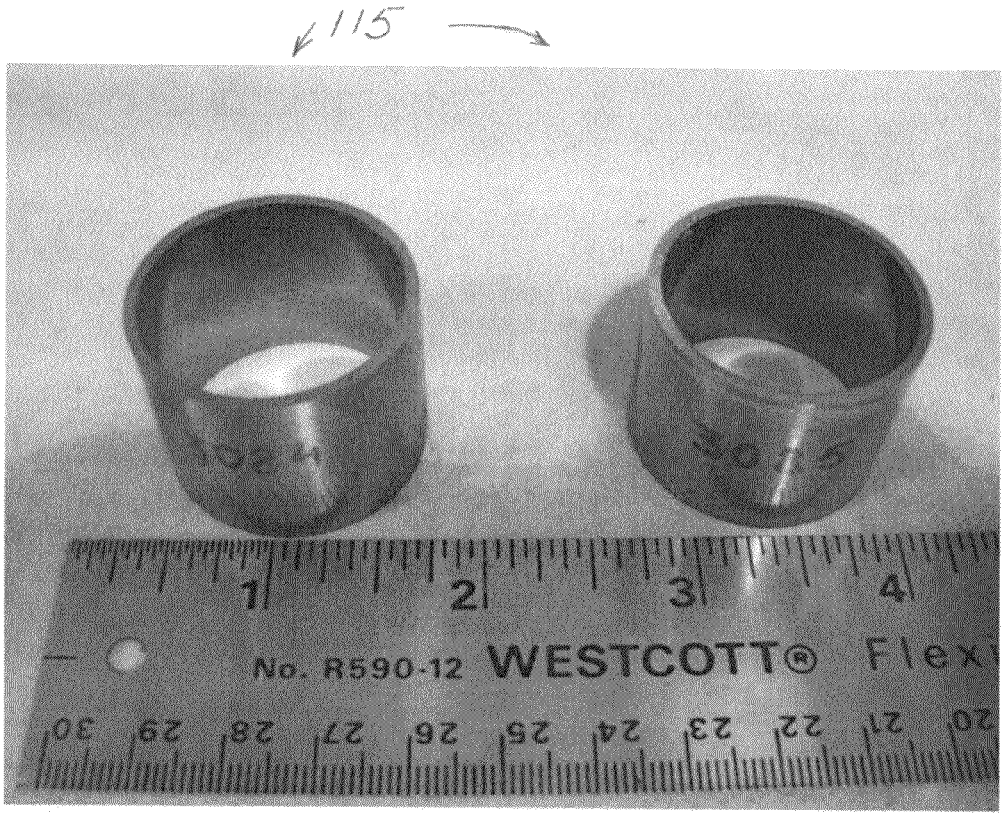
Figure 26. Angular Side views of the Successfully CDC high pressure compacted Bonded Neo Thin Walled Ring Sample with Higher As-Pressed Green Densities without any Cracking after compacting at ~140-150 tsi After the Parts Removed from the Core Rod.

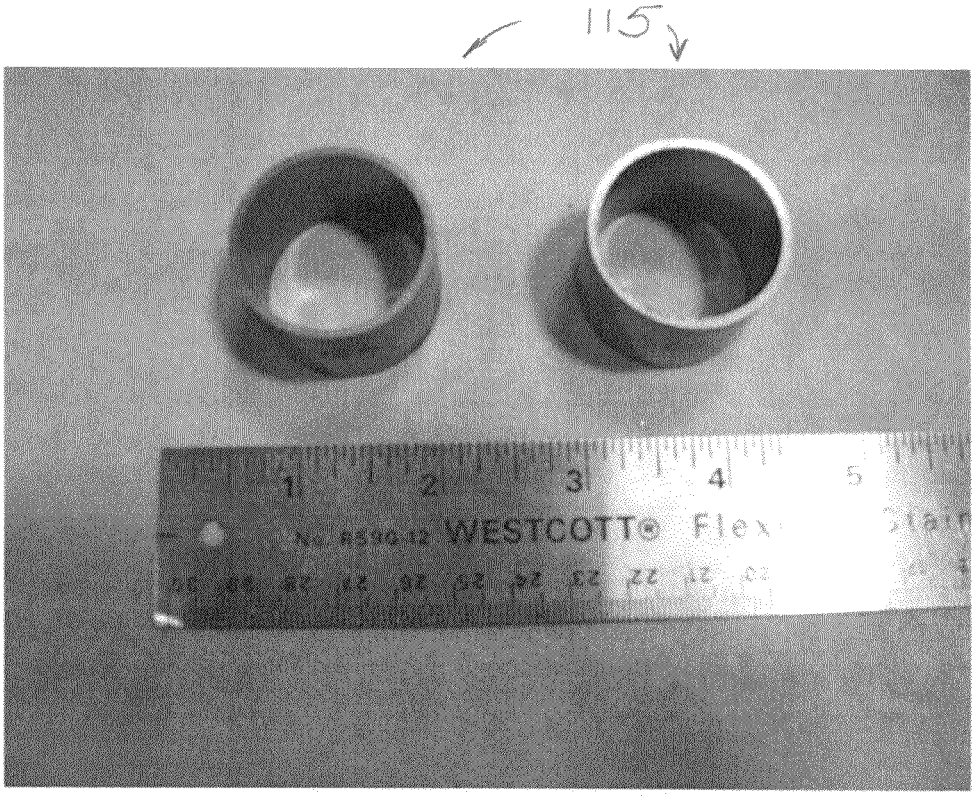
Figure 27. Top View of the Successfully CDC high pressure compacted Bonded Neo Thin Walled Ring Sample with Higher As-Pressed Green Densities without any Cracking after compacting at ~140-150 tsi After the Parts Removed from the Core Rod 115
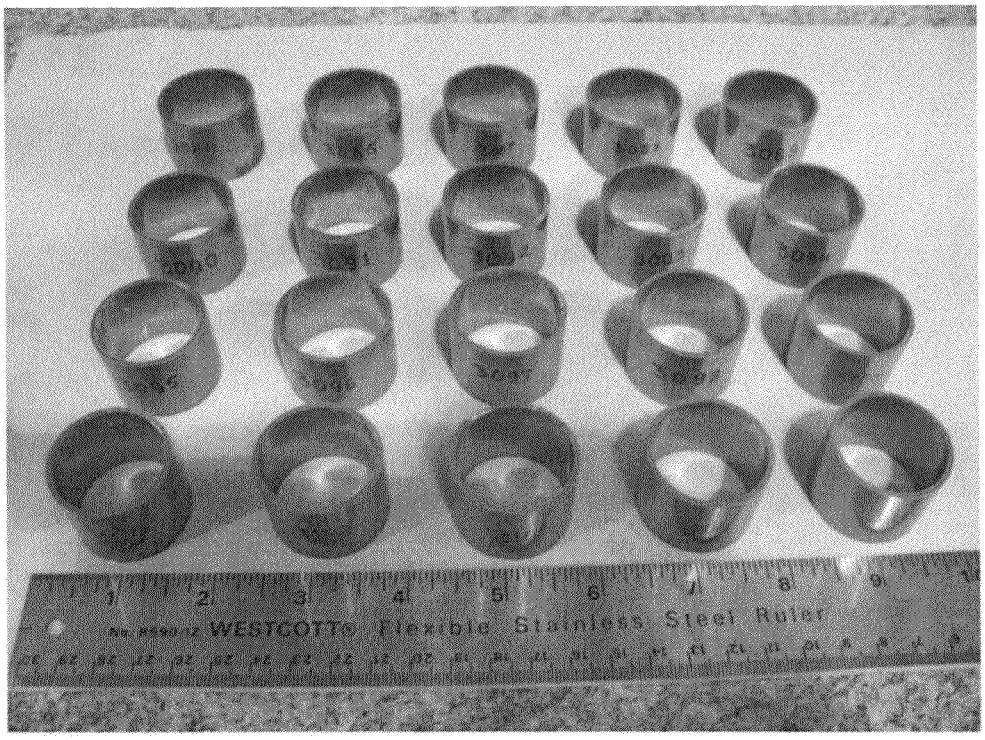
Figure 28. Successfully Reproducible CDC high pressure compacted Bonded NdFeB -Alloy Magnet-Thin Walled (~0.060 inch wall thickness; Aspect Ratio of Ring Samples with Higher As-Pressed Green Densities without any Cracking after compacting at ~140-150 tsi (After the Parts Removed from the Core Rod)

MAGNET CONSTRUCTION BY COMBUSTION DRIVEN HIGH COMPACTION

This application claims the benefit of U.S. Provisional Application No. 61/396,231, filed May 24, 2010, which is hereby incorporated by reference in its entirety as if fully set forth herein.

SUMMARY OF THE INVENTION

Utron's Combustion Driven Compaction (CDC) uses controlled release of chemical energy from combustion of natural gas and air to compact magnetic powders up to 150 tsi for obtaining net shape high-density pressed thermally processed final parts for high performance permanent and soft magnets. FIG. 1 shows a CDC, with a combustion chamber on the right.

Traditional powder compaction molding (PM) limited to 50-55 tsi and metal injection molding (MIM) produce lower density magnets (e.g., 5.85 to 6 g/cc) with correspondingly lower magnetic properties. Conventional low pressure powder compaction or injection molding lead to relatively higher % of geometrical dimensional changes.

Utron's CDC press operation fills a die with magnetic powder, fills a chamber to high pressure with a mixture of natural gas and air. As the chamber is being filled, the piston or ram moves, pre-compressing and removing entrapped air from the powder. The gas supply is closed, and an ignition stimulus is applied, causing the pressure in the chamber to rise dramatically, further compressing the metal powder to its final net shape. Utron's basic CDC compaction process and CDC 300, 400 and 1000 ton presses compaction presses are manual or automated to fabricate 1 to 6 magnets/minute, depending on part geometry. The Utron CDC magnet compaction process provides high compaction pressures up to 150 tsi, resulting in very high-density magnets with improved properties. In addition to the unique loading sequence and high tonnage the process occurs over a few hundred milliseconds. A typical UTRON's CDC produced load shown in FIG. 3*a* illustrates the faster process cycle time of milliseconds. Conventional magnetic powder mechanical and hydraulic pressing is limited to ~50-55 tsi with lower as-pressed green densities followed by large shrinkages.

Permanent magnetic materials are developed for their property attributes of high induction, high resistance to demagnetization, and maximum energy content. Permanent magnets are primarily used to produce magnetic flux fields, which are a form of potential energy). Table 1a provides an overview of several end use applications. Table 1b provides select magnetic property data of commonly used permanent magnets, including those of bonded NdFeB magnets containing resins manufactured by conventional methods of manufacturing. FIG. 3*b* shows the commonly used magnetic geometries. FIG. 3*c* shows the importance of NdFeB based magnets for obtaining better magnetic strength properties.

Magnetic induction (Br) is controlled and limited by alloy composition. Resistance to demagnetization (coercive force Hc) is conditioned to less extent by composition than by shape, or crystal anisotropies, precipitations, strains and other imperfections, including finer particle sizes. Samarium cobalt-based rare earth magnets, as indicated in Table 1b, are for higher temperature use as compared to NdFeB type magnets. Rare earth magnets are the most sturdy type of permanent magnets available at present for various end use applications. These permanent magnets are manufactured by us using several rare earth elements. Owing to the brittle nature of these magnets, especially without any resins, many powder compaction methods involve resin-containing rare earth compounds (e.g., bonded neo compositions have epoxy or similar resins added in various proportions). Conventional metal injection molding and lower pressure powder metallurgical (PM) compaction methods of these bonded magnets are known to provide relatively lower as-pressed/thermally processed densities (e.g., 5.85 to 6 g/cc are common, depending on the bonded neo compositions, type of resins, lubricant additives etc.), with correspondingly relatively lower magnetic properties.

So far in the previous arts as reported in the literature around the world, there are number of attempts by both academia and industry to develop rapidly solidified Nd—Fe-B magnet powders using a variety of rapid solidification followed by suitable milling/grinding etc. However, there has not been any breakthrough scientifically to further advance developing competitive alloy mixes, or compacting mixes uniquely using controlled high pressure above >50-55 tsi and rapid cycle times or milliseconds of pressing cycle time.

Needs exist for improved magnets.

These and further and other objects and features of the invention are apparent in the disclosure, which includes the above and ongoing written specification, with the claims and the drawings.

BRIEF DESCRIPTION OF THE DRAWINGS

FIG. 3*b* shows permanent magnet geometries.

FIG. 3*c* shows improvements 47 in magnets in the last century.

FIG. 4*b* shows the percentage of springback of CDC high pressure compacted magnetic materials.

FIG. 4*c* shows the percent of springback of as-pressed CDC magnetic cylindrical disk samples.

FIG. 4*d* shows CDC high pressure compacted sample #549 with an aspect ratio of 3.21

FIG. 4*e* shows sample #792 with an aspect ratio of 2.18.

FIG. 4*f* shows sample #793 with an aspect ratio of 1.99.

FIG. 4*g* shows sample #794 with an aspect ratio of 1.53.

FIG. 4*h* shows sample #795 with an aspect ratio of 1.82.

FIG. 5*a* shows significant improvement of permeabiloity and Q-factor in Utron compacted CDC nanocomposite soft magnetic Fe—Ni with 3 nm SiO2 powders with higher part densities of 5.81 to 6.15 compared to the properties of traditional CoNi-Ferrite materials.

FIG. 5*b* shows dynamic hysteresis loops of CDC compacted soft magnetic nanocomposite materials up to 1 MHz for $FeNi/SiO_2$ with density of 5.81 g/cc of the same materials with small eddy current losses in the frequency ranges.

FIG. 6 shows improved BHmax properties of CDC higher pressured compacted high temperature permanent magnetic materials of SmCo/Fe composites.

FIG. 7 shows CDC high pressure compacted and thermally cured sample #s 2656, 2664, 2665 and 2666.

FIG. 8 shows CDC low pressure compacted and thermally cured sample #s 2672, 2673, 2674 and 2675.

FIG. 9 shows CDC compacted and thermally cured sample #s 2672, 2673, 2674, 2675, 2565, 2664, 2665 and 2666.

FIG. 10 shows that higher CDC compaction pressure samples have overall better magnetic properties and density than lower CDC compaction pressure samples.

FIG. 11 shows magnetic properties of Utron's kinetic higher performance bonded neo magnets (HPM Series).

FIG. 12 shows selected magnetic properties of CDC compacted bonded neo magnets.

FIG. 13 shows CDC higher pressure compacted and processed magnetic outer ring/steel core assembly for potential electric motor drive applications.

FIG. 14 shows powder fill position for thin walled magnet fabrication.

FIG. 15 shows a powder pressing position to fabricate the thin walled net shape CDC magnet.

FIG. 16 shows CDC high pressure copacted net shape magnet part ejection.

FIG. 23 shows CDC high pressure compaction loading profile for bonded neo thin walled ring.

FIG. 24*a* shows CDC high pressure compaction loading profile for bonded neo thin walled ring.

FIG. 24*b* shows CDC high pressure compaction loading profile for bonded neo thin walled ring.

FIG. 24*c* shows CDC high pressure compaction loading profile for bonded neo thin walled ring.

FIG. 25 shows a view of the CDC high pressure compacted bonded neo thin walled ring at 95 tsi after the part removal from the core rod.

FIG. 26 shows angular side views of the successful CDC high pressure compacted bonded neo thin walled ring sample with higher as-pressed green densities without any cracking after compacting at ~140-150 tsi after the parts are removed from the core rod.

FIG. 27 shows the top view of a successful CDC high pressure compacted bonded neo thin walled ring sample with higher as-pressed green densities without any cracking after compacting at ~140-150 tsi after the parts are removed from the core rod.

FIG. 28 shows successful reproducible CDChigh pressure compacted bonded NdFeB—alloy magnet-thin walled ring samples after the parts are removed from the core rod.

DETAILED DESCRIPTION OF THE DRAWINGS

Figures 1, 3A:
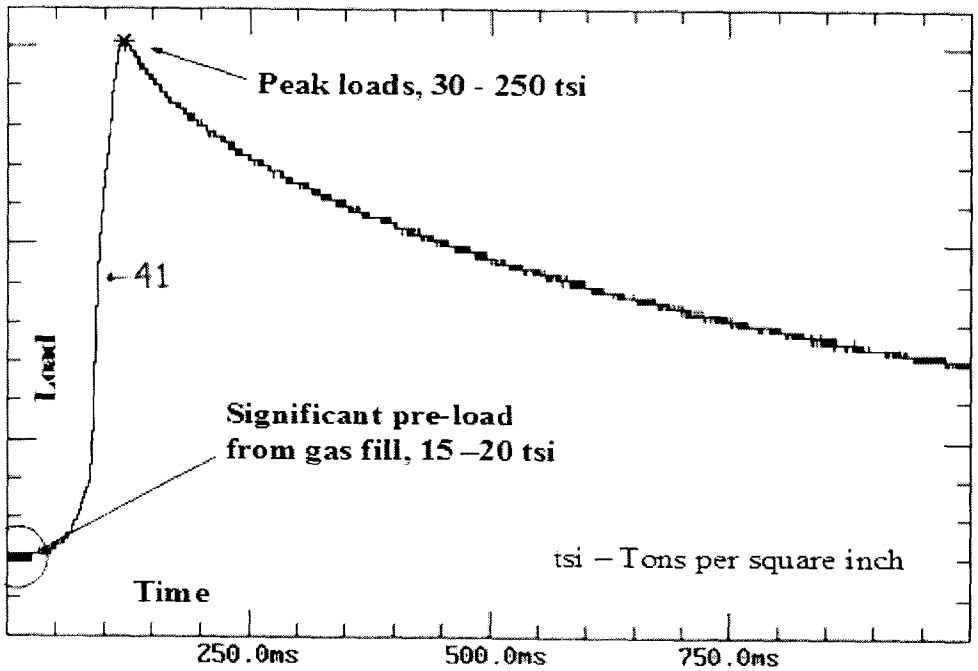
FIG. 1 schematically shows a CDC combustion driven compaction chamber on the left and shows an actual CDC chamber on the right.
FIG. 3*a* shows graphs of CDC press load force vs. time in micro seconds and magnet densities compared to load forces as well as samples of parts produced by Utron's CDC.
Figures 2, 3A:
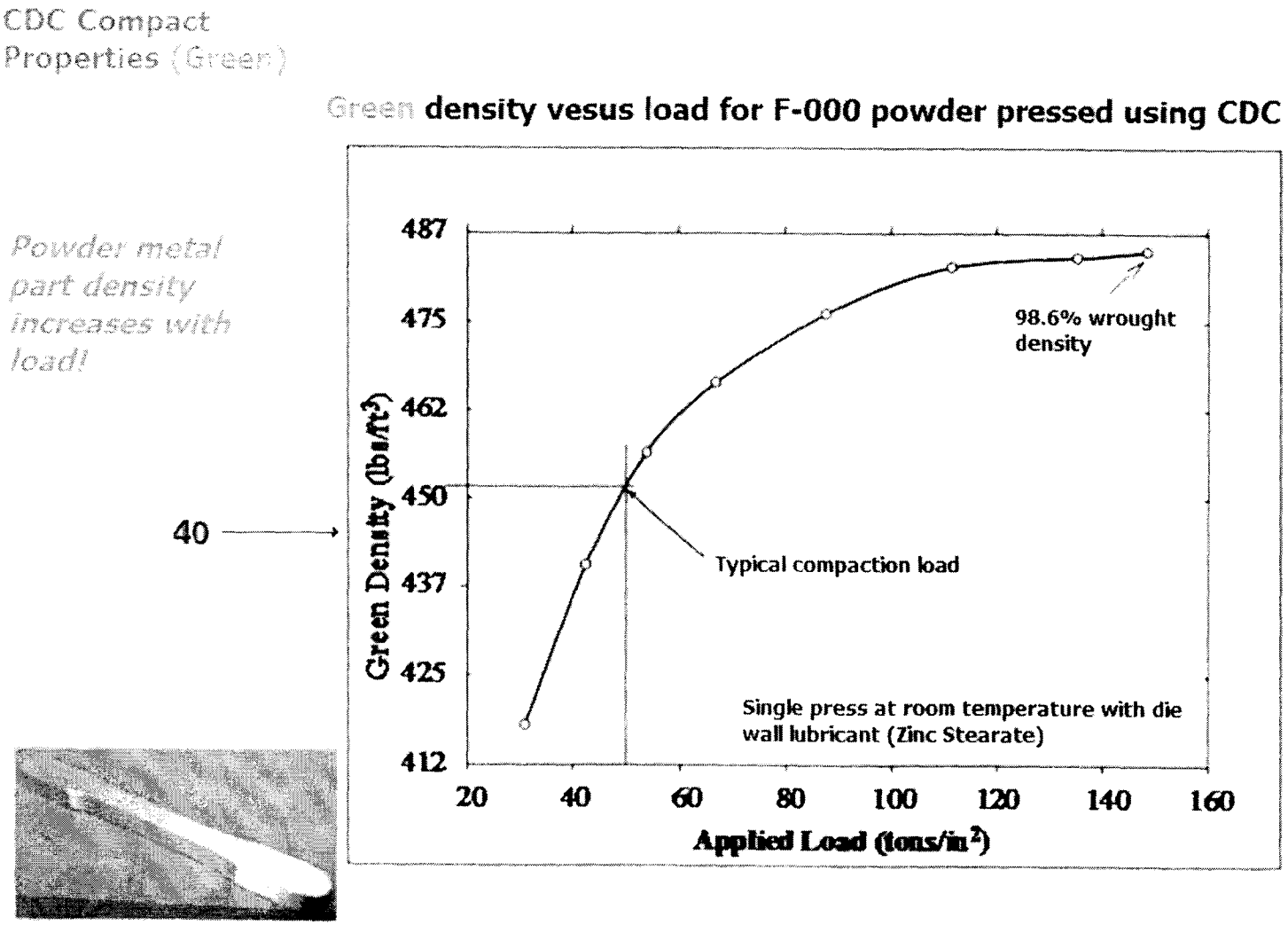
Figures 3, 3A:
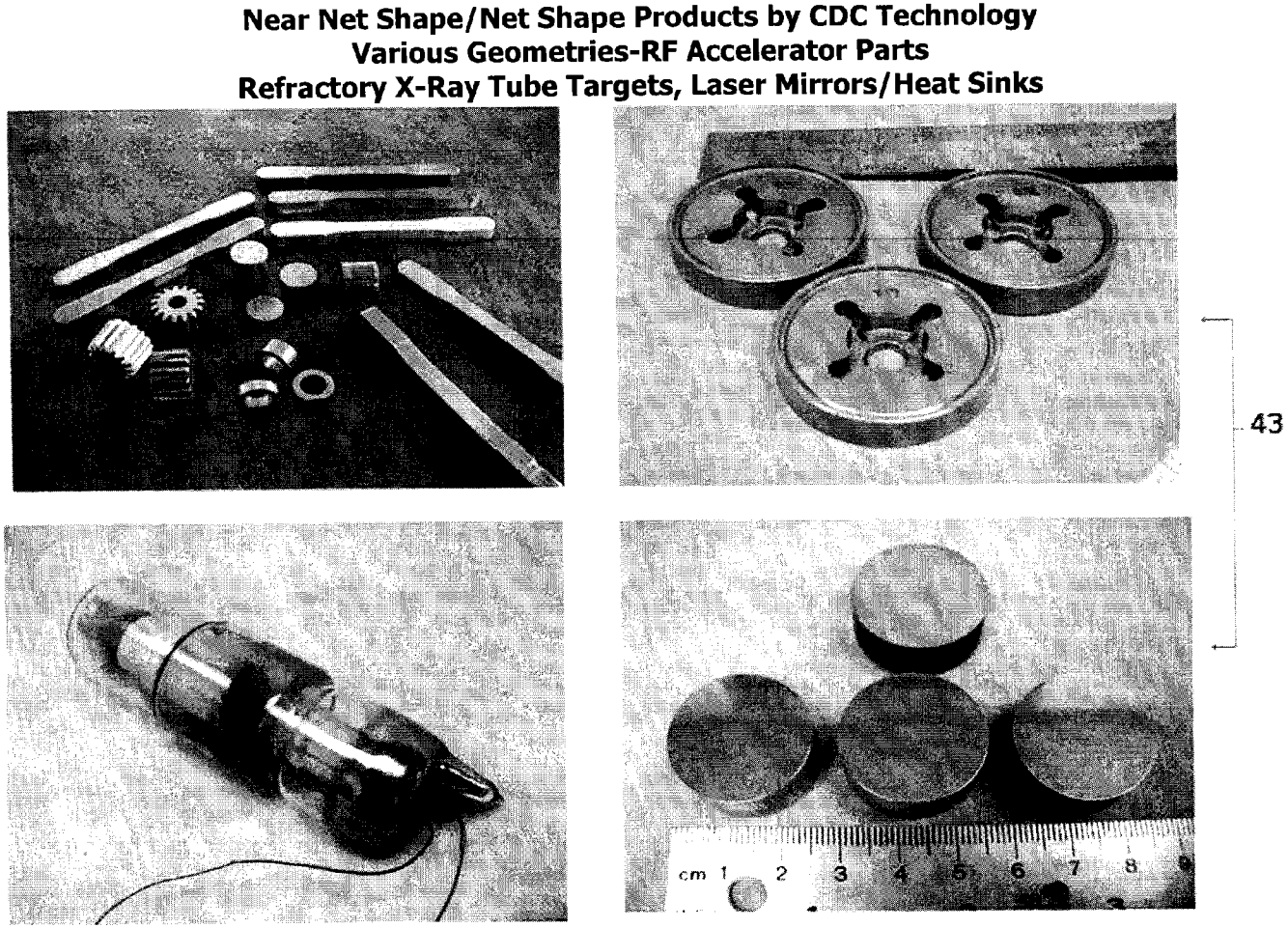
Figures 3, 3A, 4:
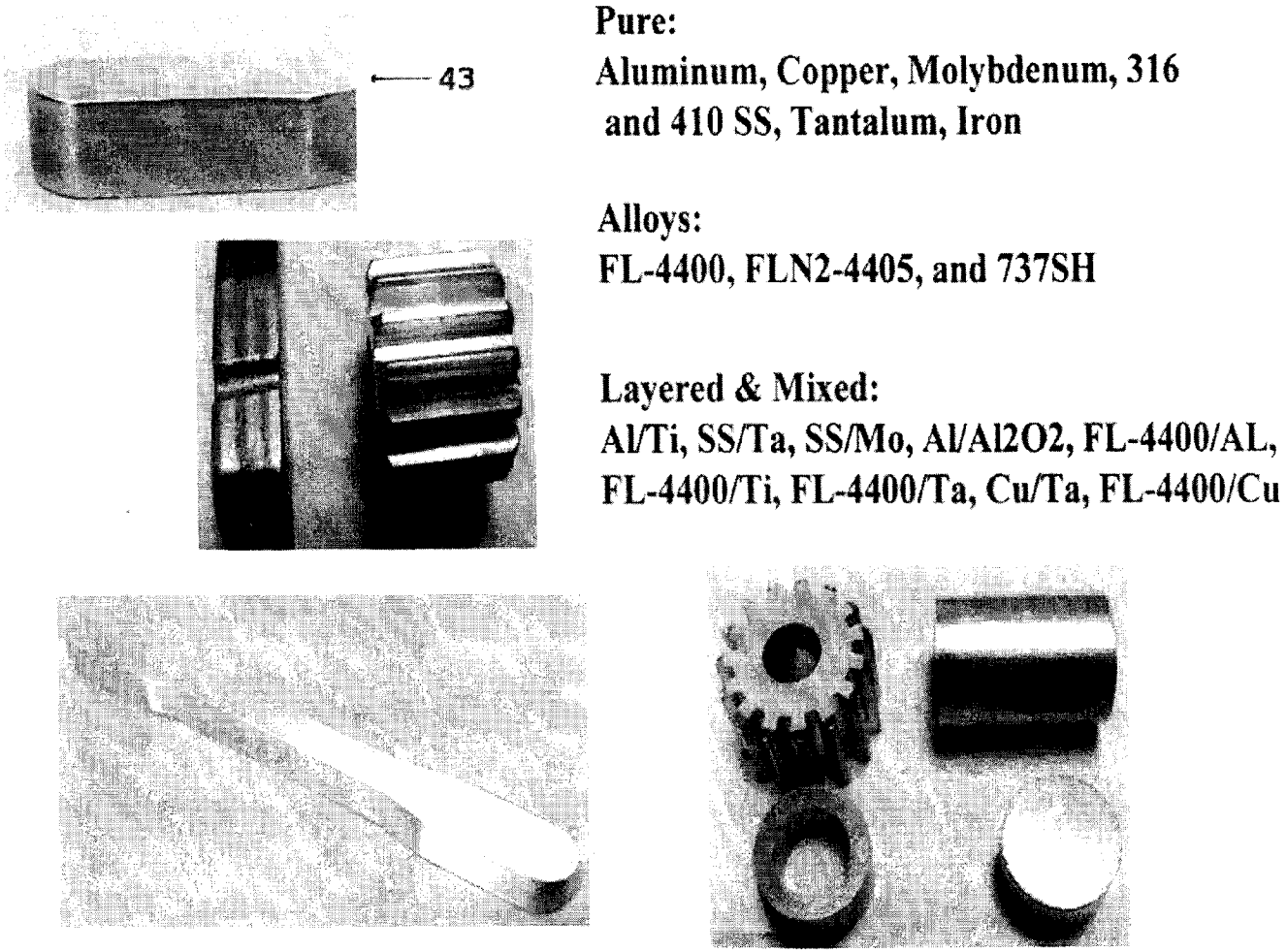
FIG. 4 shows as-pressed green densities of CDC high pressure compacted samples of broad spectrum of magnetic powders.

As schematically shown in the left of FIG. 1, a CDC press 10 has a combustion chamber 11 in a housing 13, a gas inlet 15 and electric ignition 17 that may be replaced by a laser igniter. Natural gas (CH4) and air fill the chamber 11 at high pressure. A piston 21 and coupled male die 23 form the single moving part 25. Powder 27 is placed in the female die 29.

As the gas 19 fills the chamber at high pressure, the piston 21 and moves the punch or male die 23 into the female die 29, partially compressing the powder 27. Ignition 17 provides a spark or a sapphire window admits a laser beam to ignite and combust the gas and air 19 in combustion chamber 11. The combustion products rapidly drive the piston 21 and the male die 23 into the female die, compressing the powder with several hundreds of force at pressures up to 150 tsi or more.

The combustion chamber housing 13 gas inlet 15 and electric ignition 17 are shown at the right of FIG. 1.

Figure 2:
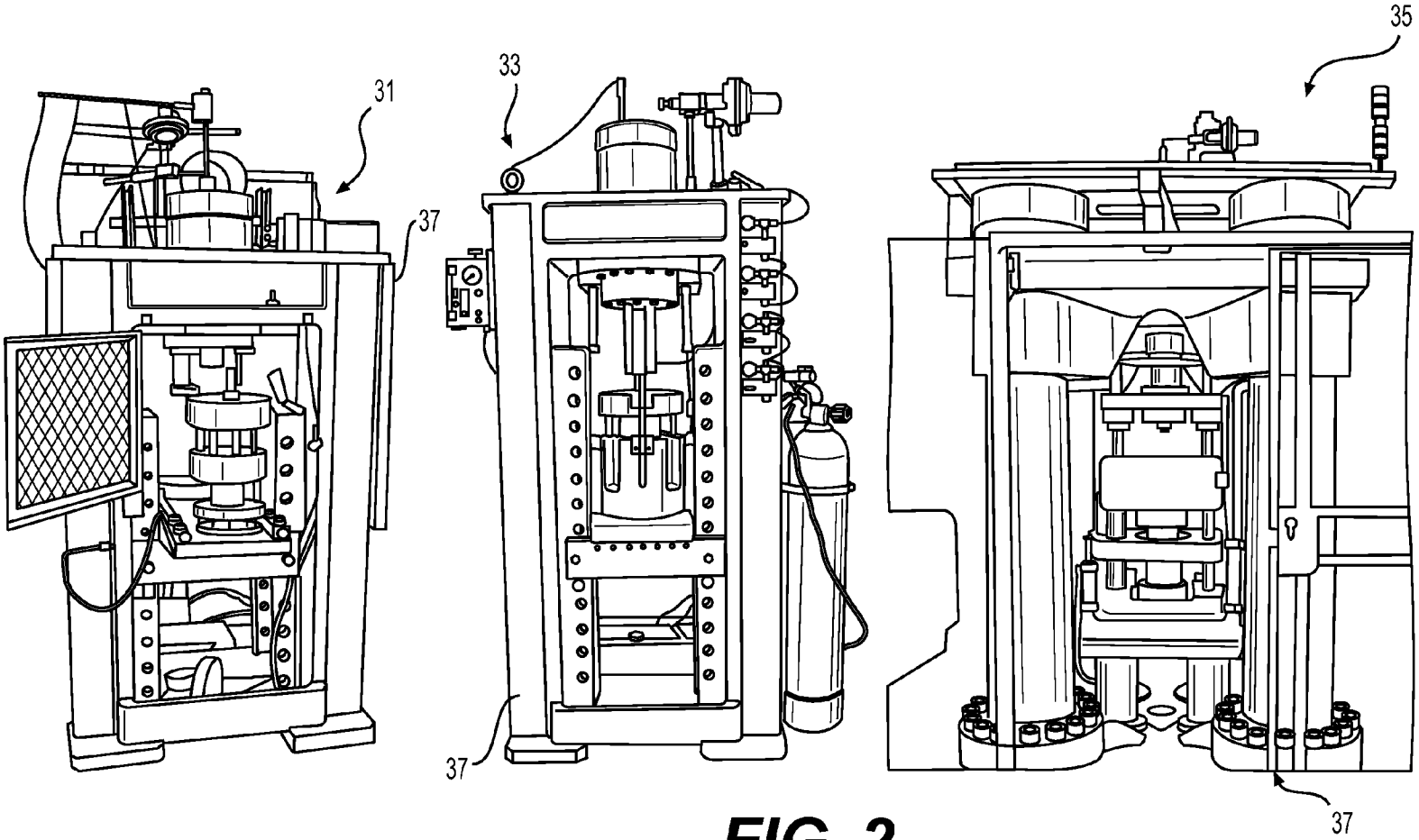
FIG. 2 shows three CDC chambers producing varied forces of compaction.

FIG. 2 shows presses 31, 33 and 35 of 300 tons, respectively. Combustion chamber housings 13 are shown at the tops of the presses and male and female dies 23, 29 are shown within the enclosures 37.

This invention provides magnet manufacture using higher pressure up to 150 tsi combustion driven compaction methods to improve not only the densification and magnetic properties. The invention uses innovative material compositions of baseline NdFeB based magnetic powders with up to 2% of other suitable type of epoxy resin additives. As well as the magnetic properties and net-shape attributes the invention fabricates complex shapes such as thin walled, e.g. 0.060 inch wall thickness, using innovative tooling and fabrication techniques.

Bonded NdFeB magnets are strong magnets which are used for various applications such as sensors, electronics, loud speakers, and in large industries. The magnets are manufactured by mixing powder with resin, which is further processed to form the magnets. The epoxy resin is used for compression molding. Using injection molding, large volumes of magnets are produced; however the magnetic value of the magnets so produced are lower. Density of those magnets produced by injection molding of about 5.8 g/cc-5.85 g/cc is typical, as compared to magnets made with compression molding using hydraulic or mechanical pressing methods. At relatively low compaction pressures of about <50-55 tsi about e.g. 6 g/cc is typical because of their relatively low density.

After the new CDC compaction, the surfaces are treated with epoxy coating or nickel-plating to prevent corrosion. To keep the bonded neodymium magnets in good condition, use along with acid, alkali, organic solvent or electrolytes must be minimized. The immersion of a magnet in water or oil may also affect its magnetism. Although bonded NdFeB magnets with protective resins are fairly stable, as compared to the bonded magnets without the resins, the bonded magnets should also be not used in spaces filled with hydrogen, corrosive gases and radioactive rays, as a safety precaution.

The new CDC compacted bonded neodymium magnets have many advantages; The magnets are stable and very efficient. The magnets and other parts may be formed together in a single step. For multi polar applications, there is a free choice of magnetizing direction. The magnets have high dimensional accuracy and are available in different shapes and sizes. The magnets have high resistance to atmospheric corrosion and have the highest magnetic properties among other isotropic magnets.

To improve the corrosion resistance, some bonded neo and other permanent magnets are coated with epoxy, zinc, nickel or gold, and such protection also provides extra firmness.

These magnets are widely used in computer hard drives, fishing reel brakes, audio speakers, bicycle dynamos, and more products. On a relative cost basis, neodymium based magnets are relatively lower in cost as compared to samarium-cobalt alloys due to their complex manufacturing process and their special quality to withstand high temperatures. Commonly fabricated shapes of permanent magnets such as short cylindrical slugs, rings, long cylinder, blocks, segmented shape etc. are shown in FIG. 3*b*.

Bonded neodymium-iron-boron magnets are of great value and interest due to their uses for several electrical motors and other applications. Bonded neodymium has unique physical and magnetic characteristics, many of which can be advantageous to a motor's size and performance. Although each motor has its own parameters to fulfill, technical strategies and efforts have generally been steered along the following areas to demonstrate how bonded neodymium can be used to reduce weight, reduced size, improve efficiency, improve performance, Reduce costs and lower eddy current losses.

In many applications, traditional ferrite motors have been replaced with bonded neo magnets, due to their improved magnetic performance and weight reduction, which are attractive for automotive components and other applications as indicated in Table 1a. There are numerous sensors, brushless DC electric motors and other applications in which thin walled magnets are used as well as for fabricating rotors with magnets as one assembly. We have successfully fabricated not only permanent magnets of various materials and compositions but also rotor-magnet assemblies using CDC higher pressure compaction.

Bonded magnet materials can be created through injection molding and can be made from NdFeB, strontium ferrite or a combination of the two. Bonded magnets that are created through injection molding can be molded into complex shapes and also can be molded directly onto components. Bonded magnets also can be created through the process of compression bonding which offer higher magnetic output but are limited to simpler geometries than injection molded materials. Compression bonded magnets can be made from either NdFeB or SmCo powders.

Injection molded neo magnets binders including Nylon/PPS/polyamide have a temperature range of −40 deg C. to 180 deg C., tight tolerances off the tool and reasonable mechanical strength properties.

Compression bonded neo magnets have higher magnetic strength due to higher magnetic particle density. Epoxy binder provides resistance to normal industrial solvents and automotive fluids. Epoxy coating is done after manufacturing to prevent oxidation. Compression bonded neo magnets typically operate in the temperature range of −40 deg C. to 165 deg C., provide tight tolerances off the tool and have better mechanical strength properties than injection molded magnets. Epoxy is a better polymer matrix choice for bonded magnets due to epoxy's unique bonding, curability at low temperatures and strength properties.

Bonded magnet materials are isotropic and can be magnetized in any direction, have a wide range of existing tool sizes and are available in rings, discs and rectangles. Existing multipole magnetizing fixtures provide quick prototyping. Bonded magnets are easily machined. Multipole rings simplify assembly verses using arc segments.

The new invention provides improved results of CDC compacted and processed bonded Nd—Fe-B magnets and their unique improved densification, and higher remnance, coercivity and combined products as compared to those obtained by conventional lower density (5.85 to 6 g/cc) bonded magnets.

CDC higher pressure powder compaction provides many advantages. The higher pressure combustion driven powder compaction (CDC) provides >50 tsi up to 150 tsi and has several advantages as compared to traditional low pressure powder pressing methods. The CDC magnet production employs chemical to mechanical energy conversion (FIG. 1) using commonly available chemicals, natural gas or methane and air, to obtain controlled combustion for pressing parts at higher pressures up to 150 tsi. Much higher pressed green and sintered part densities 40 are obtained using compact equipment, providing gentler, smoother and continuous dynamic loading cycles with milliseconds 41 pressing time duration shown in FIG. 3*a*. CDC compaction provides pressed parts 43 in near net shape and assembled shaping ability for variety of materials including single materials 43 as shown in FIGS. 3*a* and 3*b*. FIG. 3*c* shows improvements 47 in magnets in the last century. The CDC magnet manufacture provides faster process time milliseconds of compaction and improved density of the parts with unique CDC loading cycles and amenability to make simple to complex parts as shown in the figures. The results are much less part shrinkage, for example 50% lower than possible by traditional processing methods. Scalability is an advantage as shown in FIG. 2 with 300, 400 and 1000 Ton CDC presses 31, 33 and 5 and much higher tonnages of several thousand tons with minimal press sizes, unlike the traditional low pressure powder metallurgy compaction presses. The unique suitability provides for high micro or nano powder consolidation to obtain much higher magnet and connected part densities, minimal grain growth, and composite multi-layered/functional gradient materials (FGM) fabrication and improved high performance properties of net shaping, superior surface finish, and improved mechanical/wear/corrosion/durability. Less or no post-machining or grinding is needed. Varied magnet sizes and compressions are provided with scalability to higher capacity CDC press sizes, automation and rapid fabrication.

Tables 1-9 and FIG. 1 through FIG. 28 provide the key results of the CDC higher pressure compacted samples and their unique properties such as geometrical, physical, and significant improvement in the magnetic properties as compared to the typical properties obtained so far.

Table 1a provides an extensive spectrum of potential applications of permanent magnets in several types of electric motors including brushless motors, magnetic resonance imaging, holding devices, power meters, transducers, magnetic couplings, magnetic separators, transport systems, and host of aerospace, automotive, and other commercial applications. Soft magnet and composites are useful for applications such as solenoids, relays, motors, generators, transformers, magnetic shielding etc. Table 1b provides select representative magnetic properties of permanent materials of various alloys and the bonded NdFeB alloys reveal Br of 9 kG, Hci of 9 kOe and BHmax of 9.5 MG Oe.

CDC compacted magnets using sintered magnetic powders are obtained without any additional bonding resins.

We have compacted successfully metals, ceramics, and composites including macro, micro and nano materials including variety of magnetic materials, bonded Nd—Fe-B magnets, soft Fe—Ni/Nano $SiO_2$ nano composite magnets, SmCo magnets and SmCo with nano Fe. Table 2 provides an overview of both soft and permanent magnetic samples fabricated by CDC higher pressure compaction. FIG. 4*a* indicates the higher as-pressed green densities 50 of the CDC higher pressure compacted magnets with relatively minimal spring back %. Spring back % is the change in green part dimension after pressing, with reference to the initial die cavity dimensions. FIG. 4*b* indicates the spring back % 51 for 0.5 inch diameter CDC magnet ring samples and FIG. 4*c* indicates the spring back % 53 for 0.5 inch diameter cylindrical magnet disk samples.

FIGS. 4*d*-4*h* show compacted samples 54-58 of different compositions and aspect ratios. FIG. 4*d* shows CDEC high pressure compacted sample #549 (FeNi—30% $NiFe_2O_4$) with an aspect ratio (part height/wall thickness) of 3.21. FIG. 4*e* shows sample #792 ($FeCoSiO_2$ 15% Fe) with an aspect ratio of 2.18. FIG. 4*f* shows sample #793 (FeNi(100 nm)/$SiO_2$(3 nm) 15% Fe) with an aspect ratio of 1.99. FIG. 4*g* shows sample #794 (Fe/$SiO_2$) with an aspect ratio of 1.53. FIG. 4*h* shows sample #795 (Fe/$SiO_2$) with an aspect ratio of 1.82.

CDC has been used for compacted SmCo—Fe composite magnets. For samarium cobalt-containing Fe nanocomposites, low temperature compaction is needed to prevent decomposition of Sm—Co. The reported BHmax energy product for combustion driven compacted Sm—Co with Fe composite is, BHmax of 31.5 MGOe. Such improvement in magnetic property as compared to the properties obtained by other methods such as hot isostatic pressing (HIP) or plasma pressure compacting (P2C) validates not only the scientific breakthrough of the uniqueness of CDC higher pressure 150 tsi cold pressing of the difficult-to-consolidate nanocomposite powders to retain the higher magnet part densities without cracking the sample under optimized compaction process controls and also provides minimal thermal post-process requirements. The following CDC compacted magnetic materials have been evaluated for magnetic properties as shown in FIG. 6 by a CMU researcher, indicating the unique advantages of higher intrinsic coercive force, Hci force as well as higher BHmax for CDC compacted magnets.

Examples are:

($SmCo_5$)0.85 Fe0.15:P2C ($SmCo_5$)0.85 Fe0.15:CDC ($SmCo_5$)0.80 Fe0.20:HIP

T=300K

Conditions used for compaction using various methods include P2C: Plasma Pressure Compaction (73 MPa, 5 min. 600° C.); CDC: Combustion Driven Compaction (2000 MPa, 550 ms, "20° C.", Utron, Inc.); HIP: Hot Isostatic Pressing (0.435 MPa, 5 min, 550° C.)

CDC compacted soft magnetic nanocomposites have proved advantageous. Results 60 shown in FIGS. 5*a* and 5*b* show permeability 61 of CDC compacted soft magnetic nanocomposites 63 of Fe—Ni alloy powder system with 3 nm layer silicon oxide reveal much better permeability and high Q factor 65 qualities including very low hysteresis losses 67. These unique soft magnetic properties result from CDC higher pressure compacted soft nanocomposite magnetic materials with unique higher part densities and minimal post-process annealing done at lower temperatures for high frequency applications up to 1 MHz.

FIG. 6 shows improved BHmax properties 69 of CDC higher pressured compacted high temperature permanent magnetic materials of SmCo/Fe composites (CMU Research Project Publication); CDC-Combustion drive compaction; P2C-plasma pressure compaction; HIP (hot isostatic pressing).

The desirable characteristics of soft magnetic materials include higher permeability, high saturation induction (Bs), low-hysteresis loss, low-eddy current loss in alternating flux applications, constant permeability at low field strengths and minimum change in permeability with temperature. The effects of impurities, crystallinity or amorphous nature of the materials all affect properties. Structure insensitive properties are saturation induction (Bs), resistivity and Tc (Curie temperature) and structure sensitive properties which are affected by impurities or alloying elements, residual strain, grain size, etc are permeability (μ), coercive force (Hc), hysteresis loss (Wh), residual induction (Br), and magnetic stability. Controlling structure sensitive properties is accomplished through proper manufacturing process of the alloy and alloy compositions and use of proper thermal processing treatment without affecting the magnetic properties.

Significant improvement of permeability and Q-factor result from the UTRON compacted CDC nanocomposite magnetic Fe—Ni with 3 nm $SiO_2$ powders, with higher part densities of 5.81 to 6.15 g/cc compared to the properties of traditional CoNi-ferrite materials. FIG. 5*b* shows dynamic hysteresis loops of soft magnetic materials up to 1 MHz for FeNi/$SiO_2$ with density of 5.81 g/cc of the same materials with small eddy current losses in the frequency ranges.

CDC higher pressure compacted bonded neo magnets have improved properties.

Table 3 provides the listing of several CDC higher pressure compacted bonded Neo magnetic alloys and compositions. This invention provides CDC higher pressure compaction of up to 150 tsi, with unique compositions of mechanically blended magnetic powders and suitable epoxy resins in various percentages. Varying higher densities is a function of controlling the unique epoxy resin % in both before and after CDC compaction with suitable thermal processing. Select CDC compacted MQLP-B samples 71, 73, 75 are shown in FIGS. 7-9. Thermal processing of CDC compacted bonded Neo magnets were carried out at relatively lower temperature ranges of 150-225 deg C. at controlled heating and cooling rates, and at controlled shorter thermal processing times for less than 1 hour.

Due to the higher as-pressed densities, such unique post-process thermal treatment was found to be beneficial in terms of cost-effectiveness. Also, the uniquely processed CDC bonded neo samples were evaluated for densities and magnetic properties and were found to have much higher density improvement and magnetic property improvements as compared to conventional bonded magnets. The unique CDC produced magnets also have much higher improvements in magnetic induction, intrinsic coercive force and BHmax product as shown in Table 6-8 and FIGS. 10-12.

FIG. 10 shows that higher CDC compaction pressure samples have overall better magnetic properties 77 and density than lower CDC compaction pressure samples. There is ~0.2 kOe Hci difference in between higher and lower CDC compaction pressure samples, and this has been verified by 2 sets of coil.

FIG. 11 shows magnetic properties of Utron's kinetic higher performance bonded neo magnets (HPM Series); 11*b*. Effects of CDC higher pressure compaction improve densification 78 with higher remnance (Br) 79. FIG. 11 provides the improved magnetic property data 77 for UTRON Kinetics's advanced higher performance series, called HPM series, bonded neo magnetic alloy compositions.

FIG. 12 shows selected magnetic properties 80 of CDC compacted bonded neo magnets.

We have also compacted and evaluated other higher density bonded magnets using proprietary NdFeB mixes with Magnaquench base powders MQPB and MQPB+ mixes with higher Br (7.7) and BHmax (11.5). Based on geometry needs, Utron can fabricate any shape, ring discs, rectangles, etc. FIG. 12 provides a summary of magnetic properties of select CDC compacted and thermally processed samples.

The CDC higher pressure compacted samples using higher performance magnet (HPM) alloy series developed at UTRON use base alloy magnetic powders provided by Magnaquench series powders with suitable added epoxy procured by Utron Kinetics team independently from another vendor. Resin % at UTRON Kinetics, revealed significant magnetic property improvements of Br (higher remnance or induction) and Hci (higher demagnetization field). The epoxy resin that we used was blended in varying percentages with the baseline powders provided by the magnet baseline powder supplier.

Out of several thermoset polymers such as epoxies, polyesters, polyimides, cyanate esters, and phenolics, epoxy resin in varying % was chosen to be added in the matrix due to their better compatibility with the NdFeB magnetic powders, better firmess in terms of mechanical strength and ductility, and added protection both during and after CDC pressing for intended magnet applications due to the pyrophoric nature of the magnetic baseline powders especially in the fine sizes. Conventional compression molded or injection molded bonded neo magnets typically have higher %, 1.5-2% for example of resins, which may vary depending on the powder supplier and end users of bonded neo magnets.

Based on the unique magnetic property improvement results, one of the suggested powder composition with 1% resin was recommended by the principal scientist to the baseline powder supplier to provide MQLP-B+ together with ~1% resin weight %, for use in CDC higher pressure compaction. Epoxy resins typically have curing temperatures of 350 deg F, maximum service temperatures of 350 deg F, tensile strength of 8-13 ksi, and elongation of 3-7%. In bonded neo magnets, the properties depend on the % of such epoxy resins.

CDC compacted net shape magnetic ring 81 and steel core 83 assembly is provided for use in brushless electric motor applications.

FIG. 13 shows a new single step pressed steel core 83 mounted magnet product fabricated in steps of filling a die with steel powder mixed with <1% resin inside a separator tube and filling the die outside of the separator tube with magnetic powder, followed by withdrawing the separator tube and CDC pressing the powders up to 150 tsi. Prior art separately forms a steel ring and a magnet ring and bonds them together. The new product and methods minimize the number of steps and avoids chemical contamination of bonding.

The manufacturing advantage of layered or functional gradient materials for the CDC higher pressure compacted and processed magnetic outer ring and steel core assembly is new for brushless electric motor applications. Table 9 lists the CDC as-compacted properties of several mechanical samples and other geometries for unique brushless electric motor applications. Much higher densities were determined in all of the samples. Preliminary mechanical durability properties also were much better as compared to mechanical durability of conventional bonded magnets. Another unique way of CDC compacted at 150 tsi and thermally processed assembly of magnetic outer ring and steel composite inner core as shown in FIG. 13 for electric motor applications. The thermally processed composite steel core has the hardness range of RB 65-68 and showed ultimate tensile strength levels of ~12627-13093 psi, yield strengths of 6402-5911 psi and 4.5-4.8% ductility at fracture. Baselines magnetic materials of CDC compacted bonded MQLP-B materials provide ~4000 psi strength levels. The results indicate that the core samples are almost three times stronger than the magnetic layers. Bonded magnet and steel cores have indicated fairly good bonding with no delamination etc.

Innovative tooling is conceived and developed for fabricating thin walled net shaped bonded magnet rings with high length to wall thickness aspect ratios and improved magnetic properties.

Popular magnet geometries including thick walled rings with lower aspect ratios are shown in FIG. 3*b*. At Utron, we have fabricated thick walled ring samples of magnetic materials with lower aspect ratios successfully. FIGS. 4*b*, 4*d*-4*h* provide the results of those thick walled ring geometries with lower aspect ratios (<<4).

Using conventional processing methods, there have always been fabrication challenges to fabricate thin walled magnetic geometries using bonded or sintered magnet powders with aspect ratios (ratio between height and sample wall thickness) of >5-6 or higher. Using conventional low compaction pressures, this method has been less successful due to difficulties to firmly hold and eject the low density as-pressed magnetic parts. Injection molding methods produce much lower density parts, typically 5.8 g/cc densities in MIM injection molded parts as compared to 6 g/cc in low pressure compression molding or pressing. Multi-steps were required, such as extrusion of a rod to make a tube, cutting the tube to the final length, post-process grinding to obtain net shape and surface quality, etc. We have successfully used our CDC high pressure 300-Ton compaction press for making net shape high density magnets. We have conceived unique innovative tooling described and shown in Table 10 and FIGS. 14-17, created the tooling layout 91 with a die cavity 93 and lubricated core rod 95 and hollowing cylinder punch 97, and procured the tooling, carried out various sequences of powder filling 101, powder pressing 103, and part ejection 105 shown in FIGS. 14-22 using rapid milliseconds pressing cycle time.

FIG. 14 shows powder fill position for thin walled magnet fabrication.

FIG. 15 shows a powder pressing position to fabricate the thin walled net shape CDC magnet.

FIG. 16 shows CDC high pressure copacted net shape magnet part ejection.

Figure 17:
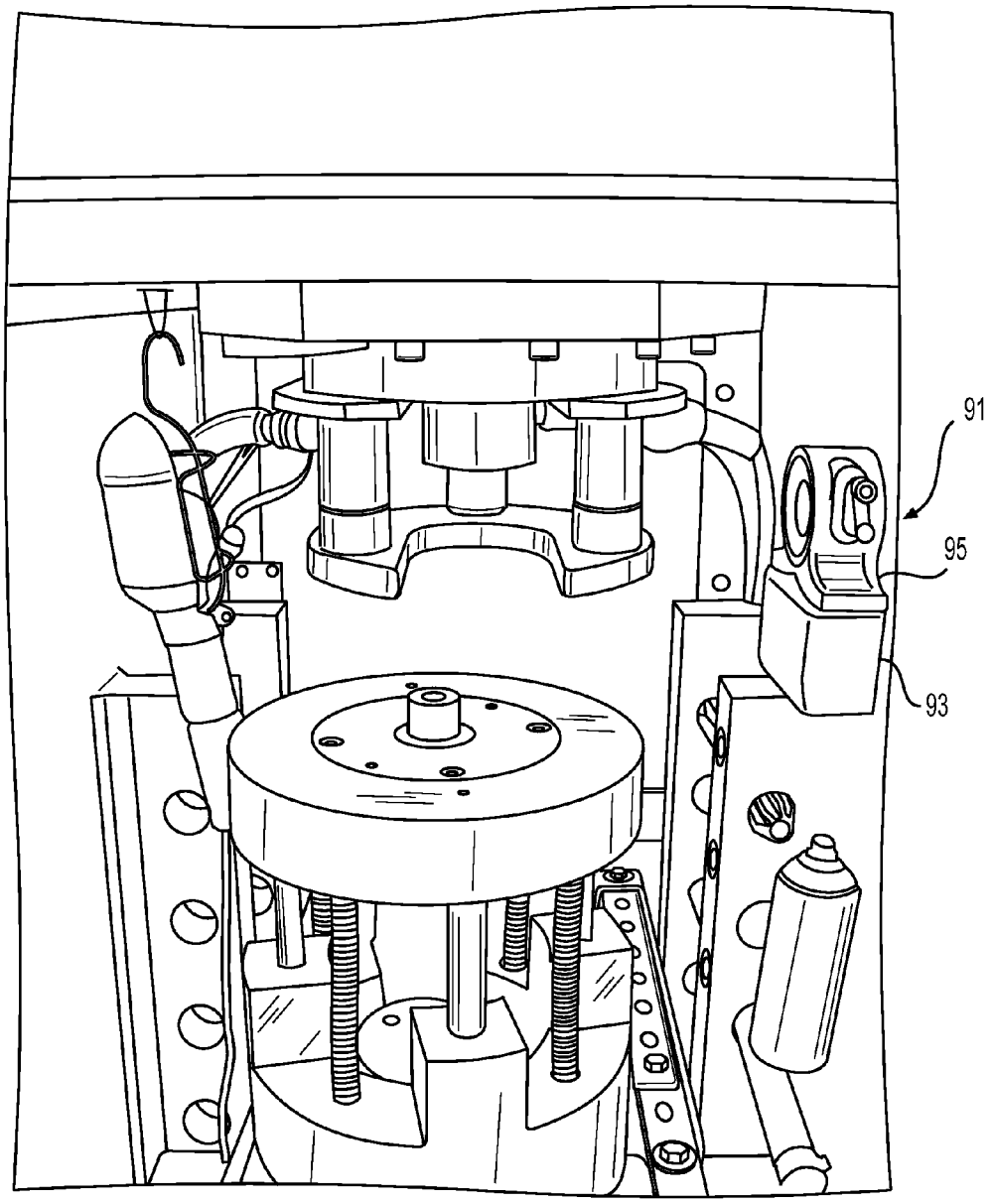
FIG. 17 shows a view of the die cavity with lubricated core rod installed in view of the tooling in the 300 ton CDC press.

FIG. 17 shows a view of the die cavity with lubricated core rod installed in view of the tooling in the 300 ton CDC press.

Figure 18:
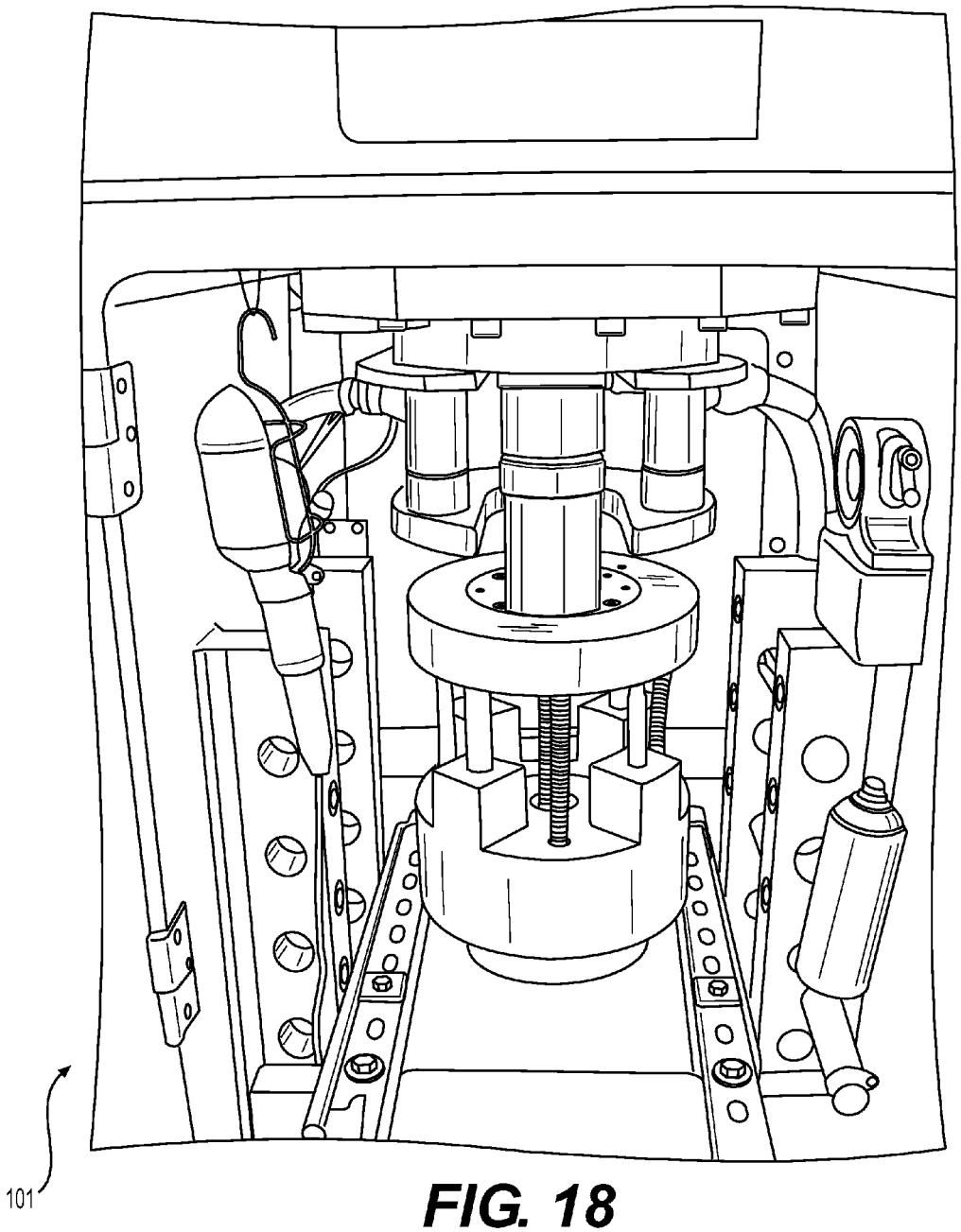
FIG. 18 shows a view of the die cavity with bonded neo powder already filled in the annular hollow region of the core rod covered by upper punch (hollow cylinder) in assembled view of the 300 ton CDC press.

FIG. 18 shows a view of die cavity with bonded neo powder already filled in the annular hollow region of the core rod covered by upper punch (hollow cylinder) in an assembled view of the 300 ton CDC press. This sequence is ready before CDC compaction at high pressures (up to 150 tsi).

Figure 19:
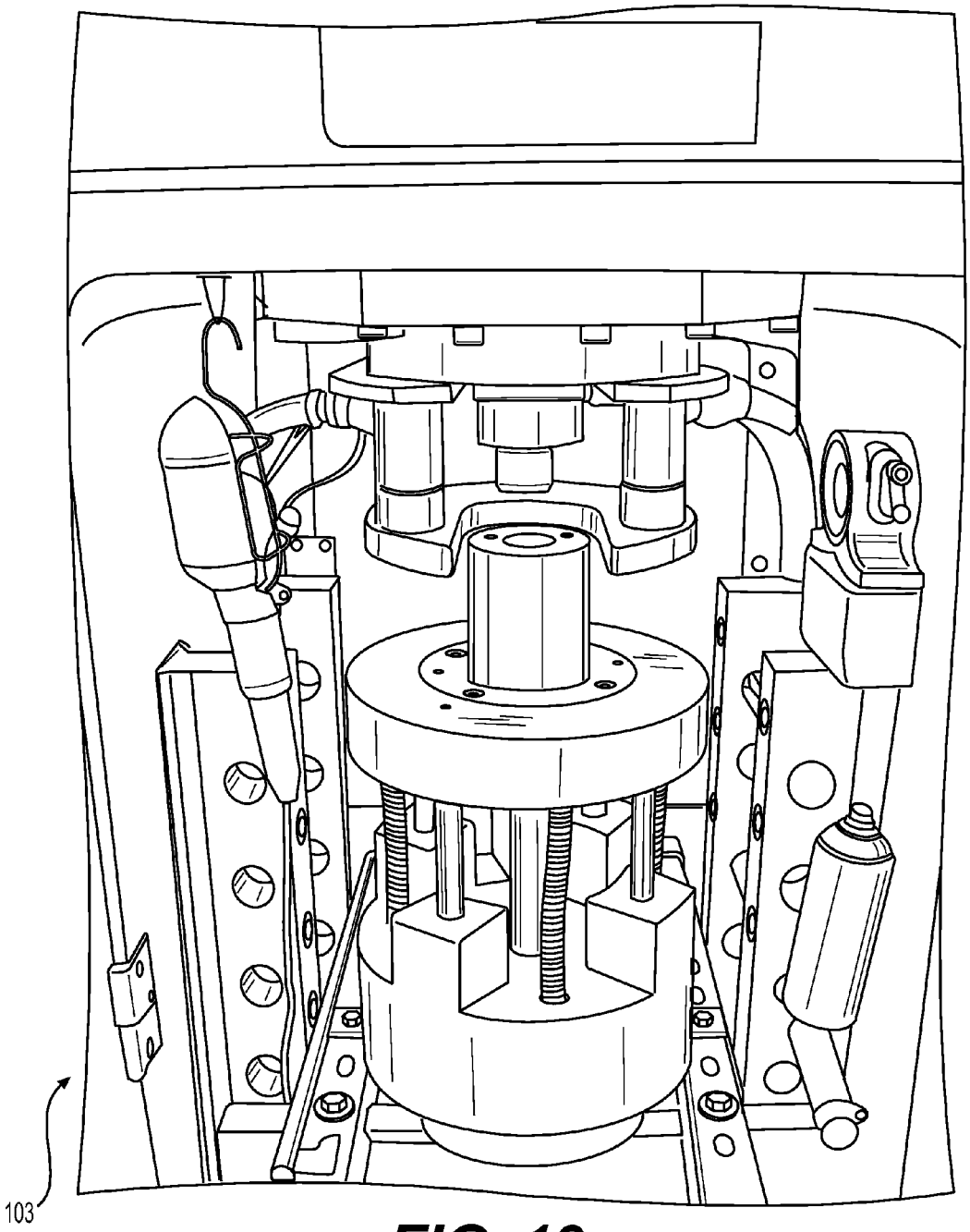
FIG. 19 shows a view of the die cavity with bonded neo powder already filled in the annular hollow region on the core red covered by upper punch (hollow cylinder) as shown in the view of the 300 ton CDC press.

FIG. 19 shows a view of the die cavity with bonded neo powder already filled in the annular hollow region on the core red covered by upper punch (hollow cylinder) as shown in the view of the 300 ton CDC press. This sequence is shown without the piston engagement from the CDC combustion.

Figure 20:
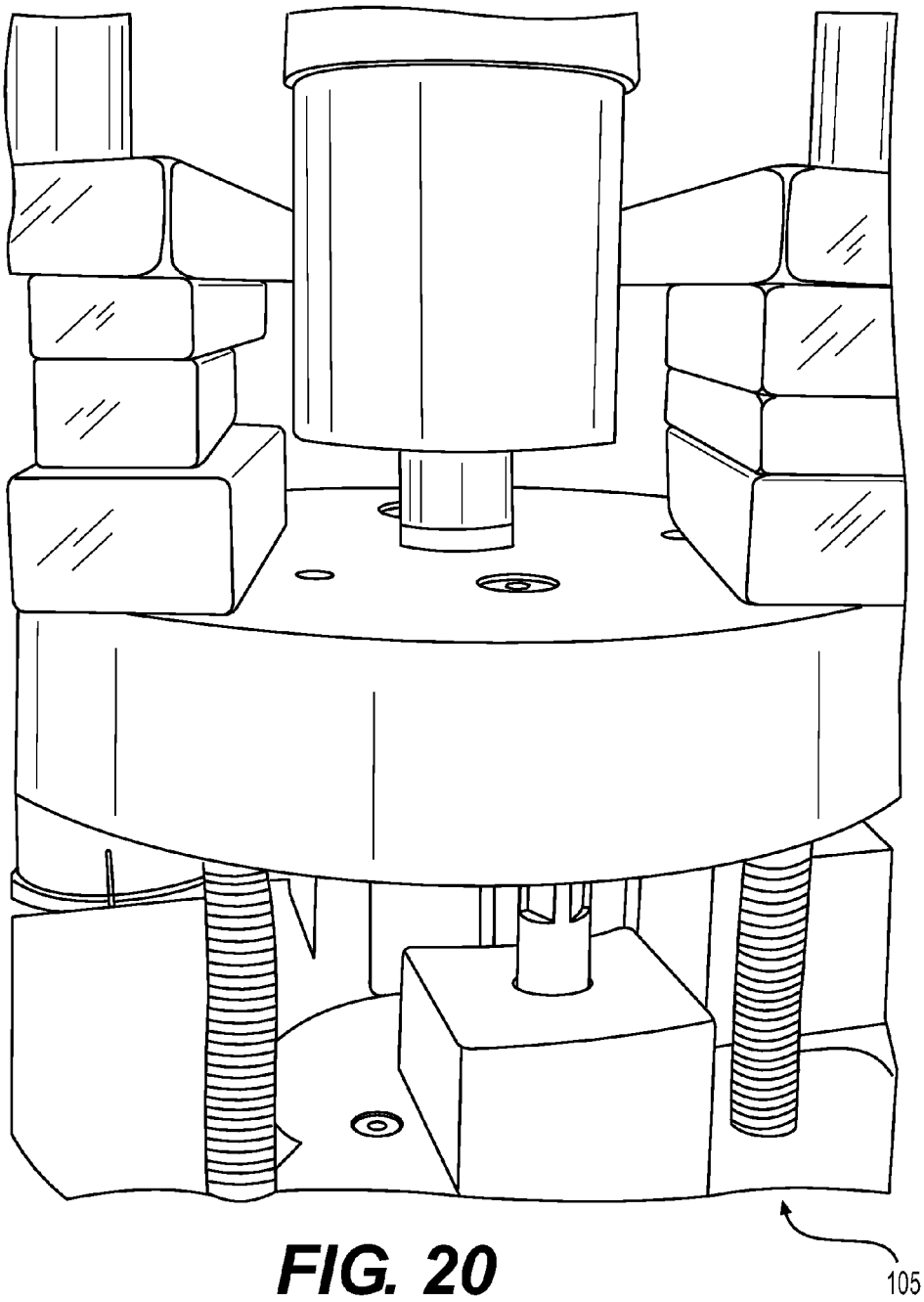
FIG. 20 shows a view of the CDChigh pressure compacted bonded neo thin walled ring in the core rod after the die cavity is lowered just before part removal.

FIG. 20 shows a view of the CDChigh pressure compacted bonded neo thin walled ring in the core rod after the die cavity is lowered just before part removal.

Figure 21:
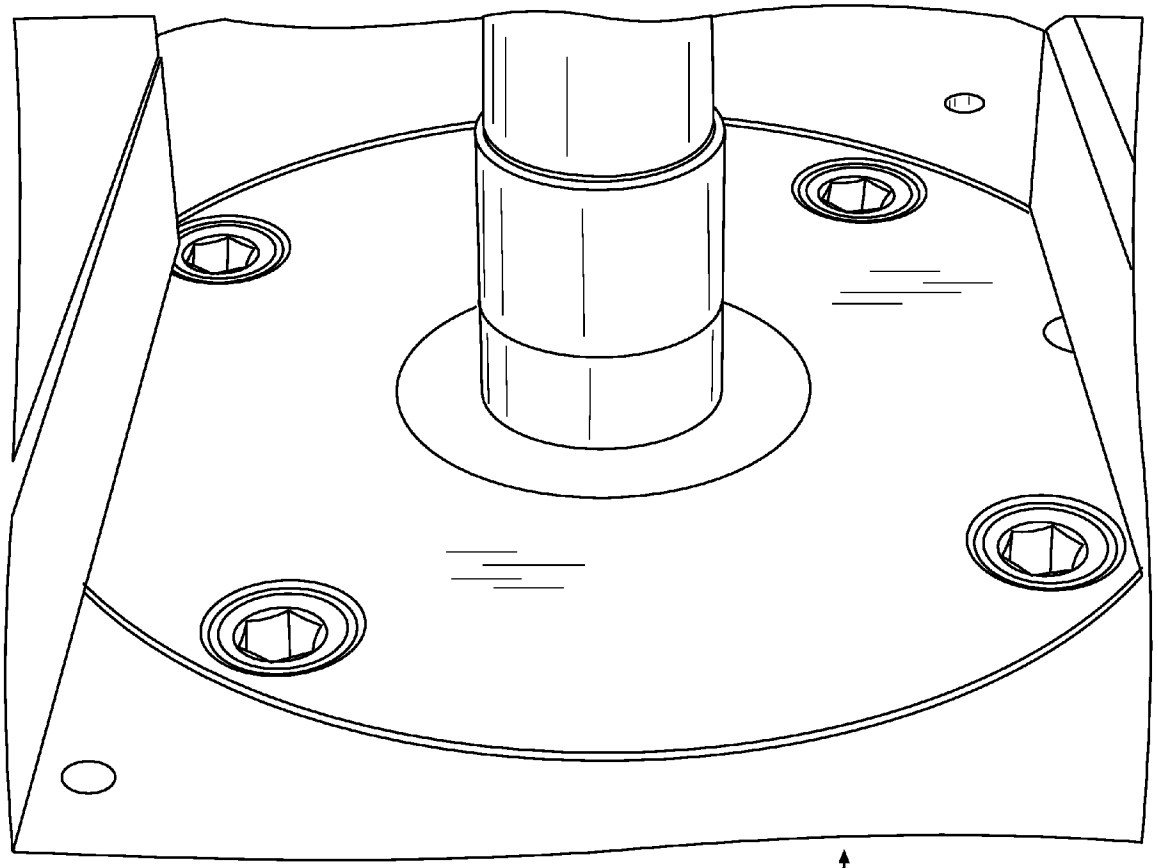
FIG. 21 shows a view of the CDC high pressure compacted bonded neo thin walled ring in the core rod just before part removal.

FIG. 21 shows a view of the CDC high pressure compacted bonded neo thin walled ring in the core rod just before part removal.

Figure 22:
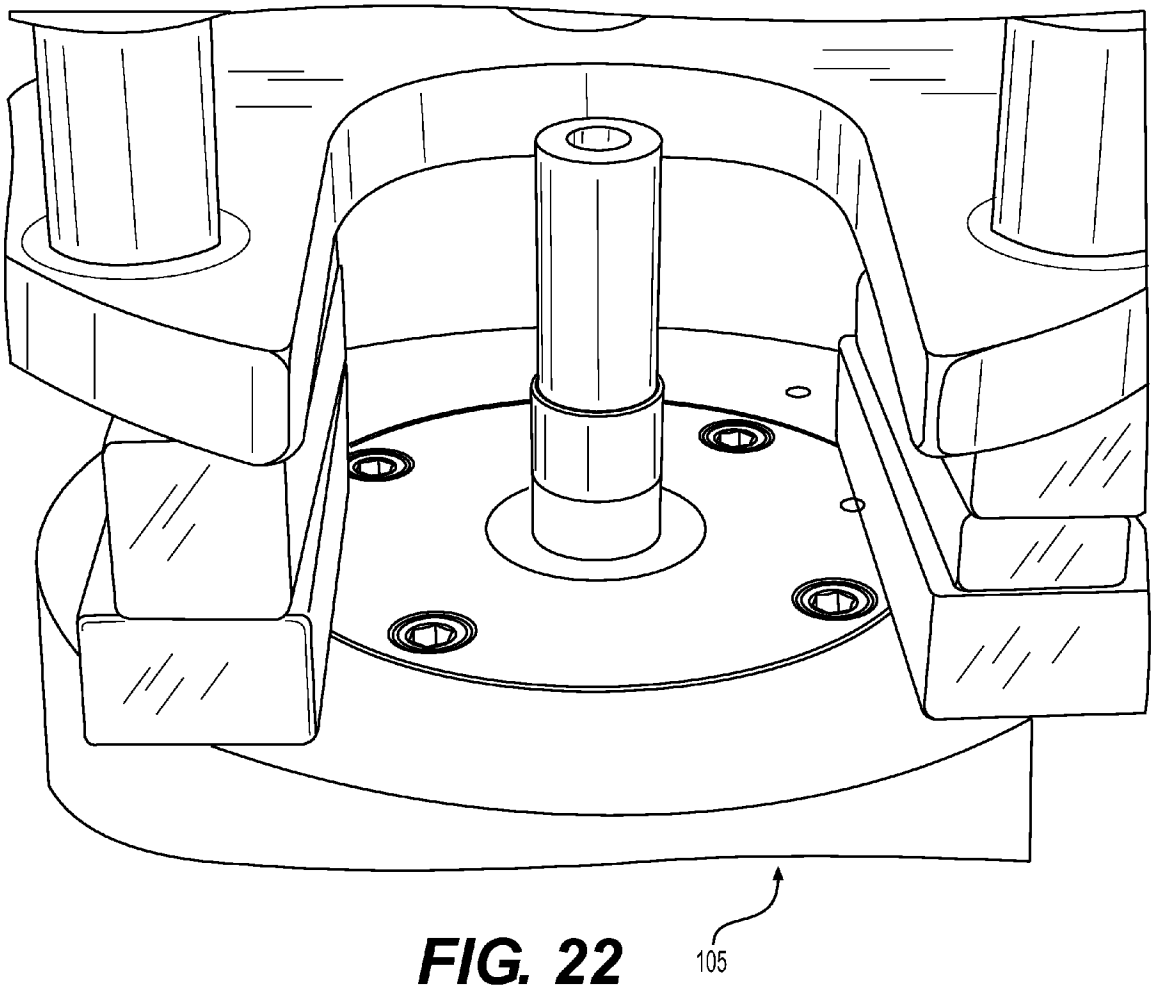
FIG. 22 shows a view of the CDC high pressure compacted bonded neo thin walled ring in the core ring rod after disengaging from the piston of the CDC combustion chamber just before part removal.

FIG. 22 shows a view of the CDC high pressure compacted bonded neo thin walled ring in the core ring rod after disengaging from the piston of the CDC combustion chamber just before part removal.

FIG. 23 shows CDC high pressure compaction loading profile for bonded neo thin walled ring (~95 tsi).

FIG. 24*c* shows CDC high pressure compaction loading profile for bonded neo thin walled ring (~140-150 tsi).

FIG. 25 shows a view of the CDC high pressure compacted bonded neo thin walled ring at 95 tsi after the part removal from the core rod (~140-150 tsi).

FIG. 26 shows angular side views of the successful CDC high pressure compacted bonded neo thin walled ring sample with higher as-pressed green densities without any cracking after compacting at ~140-150 tsi after the parts are removed from the core rod.

FIG. 27 shows the top view of a successful CDC high pressure compacted bonded neo thin walled ring sample with higher as-pressed green densities without any cracking after compacting at ~140-150 tsi after the parts are removed from the core rod.

FIG. 28 shows successful reproducible CDChigh pressure compacted bonded NdFeB—alloy magnet-thin walled ring samples after the parts are removed from the core rod.

We have created continuous, smooth and controlled CDC loading cycles with precombustion load 111 and combustion load 113 shown in FIG. 23 and FIGS. 24*a* to 24*c* to fabricate new thin walled bonded magnet rings 115 with large aspect ratios shown in FIGS. 25 through 28. The successfully fabricated rings with excellent bonding and crack-free nature were reproduced several times to verify the reproducibility and consistent geometrical and physical properties described in Table 10 as shown in FIG. 28. We plan to continue to thermally process and evaluate the improved magnetic properties similar to what we have evaluated using the 0.5 inch diameter cylindrical disk samples. Such unique innovative manufacturing of thin walled and high aspect ratios is possible using CDC high pressure compaction method, and such manufacturing is flexible for scaling up to fabricate thin walled rings of various diameters and wall thicknesses. The invention uses suitable CDC compaction press to obtain the required higher compaction pressures based on the pressing area. This invention includes fabrication of thin walled bonded permanent magnetic rings using new magnetic alloys, compositions and composites as well as rings of other materials by suitable CDC compaction process control and parameters using this invention.

Additional thin walled net shape CDC bonded neo magnet rings in addition to what is reported in Table 10 were fabricated to assure the reproducibility of one of the innovative net shape manufacturing of thin walled (e.g., wall thickness of ~0.059 inches) rings and also evaluate the properties of statistically acceptable numbers of rings identified a CDC Bonded Neo Magnets 3091-3115.

The invention provides new compositions, products, processes and apparatus for forming permanent, semi-permanent and soft magnets.

Combustion driven compaction at high compaction pressures have been successfully used to fabricate a broad spectrum of soft magnets from FeNi, FeCo-based magnetic materials and permanent magnets from Nd—Fe—B based alloys, SmCo-based alloys, etc., including bonded neo magnetic alloys of various compositions.

The CDC compacted FeNi—$SiO_2$ nanocomposite soft magnets have shown superior magnetic permeability and lower hysteresis losses. CDC compacted SmCo—Fe nanocomposite magnets have yielded far greater resistance to demagnetization, higher coercive force Hci and much higher BHmax product (31.5 MGOe) as compared to those made by other manufacturing methods such as plasma pressure compaction (P2C) and hot-isostatic pressing (HIP).

Bonded permanent magnets have been compacted with innovative varying composition mixes using baseline magnetic powders and a unique epoxy based resin, for example 3M Scotch Cast—265 electrical resin below 1% by weight, called High Performance Magnet Series. The HPMS mixes are subject to changes of baseline powders together with suitable 1% or less epoxy based resin to improve the Br and Hci together with higher BHmax properties and with improved magnetic properties.

Net shape magnetic outer ring/steel composite inner core assembly have been successful as one unit using CDC compaction at 150 tsi and thermally processed assembly for potential brushless electric motor applications. The thermally processed composite steel core has the hardness range of RB 65-68 and showed ultimate tensile strength levels of ~12627-13093 psi, yield strengths of 6402-5911 psi and 4.5-4.8% ductility at fracture. Baseline magnetic materials of CDC compacted bonded MQLP-B materials provide ~4000 psi strength levels. The results indicate that the core samples have proven almost three times stronger than the magnetic layers. Bonded steel core magnets have indicated fairly good bonding with no delamination.

Combustion driven high pressure compaction (up to 150 tsi and higher) technology has been successfully used to fabricate intricate thin walled (e.g., 0.059 inch wall thickness) higher density bonded permanent magnet ring geometries with much higher aspect ratios (e.g., Between 16.64 to 17.59 shown in Table 10) than attainable by conventional powder metallurgical compaction methods with typical ratios of 4-5 or less by using innovative tooling development and part fabrication in net shape. The produced parts have been reproduced several times for part consistency and reliable fabricability.

The higher densities for the new net shape thin walled bonded Neo magnetic rings have been reported to be far superior than densities attainable by metal injection molding (MIM), e.g. compression molding or powder pressing methods using conventional hydraulic or mechanical means of methods.

TABLE 1A

Broad Spectrum of Applications of Permanent Magnets [20]

| Application | Recommended material | Primary reason for selection | Alternative material | Condition or reason favoring selection of alternative material |
|---|---|---|---|---|
| Aircraft magnetos, military or civilian | SmCo | Maximum energy per unit volume | Cast Alnico5 | Availability or cost restraint |
| Ahematcas | SmCo | Compactness and reliability | Ferrite Alnico | Where space is available for a larger volume of material of lower magnetic energy and cost |
| Magnetos for lawn mowers garden tractors and outboard engines | Ferrite | Adequate magnetic energy at lower cost than Alnico | Alnico NdFeB | Higher energy material is required |
| Small direct current motors | Bonded ferrite | Shape favors fabrication; adequate magnetic energy at lower cost | Bonded NdFeB Sintered ferrite | Higher magnetic ercrgy is required |
| Large direct current motors | SmCo | Maximum energy per unit volume | NdFeB | Where lower cost is required, operating temperature is low |
| Automotive direct current motors | Ferrite | Adequate magnetic energy at lower cost than alternate materials | Bonded NdFeB | Higher magnetic energy and less weight |

TABLE 1A-continued

Broad Spectrum of Applications of Permanent Magnets [20]

| Application | Recom-mended material | Primary reason for selection | Alternative material | Condition or reason favoring selection of alternative material |
|---|---|---|---|---|
| Automotive cranking motors | Ferrite | Adequate magnetic energy at lower cost than alternate materials | Bonded NdFeB | Higher magnetic energy and less weight |
| Voice coil motors (computers) | NdFeB | High energy | SmCo | Availability |
| Acoustic transducers | Finite | Low cost | NdFeB | Higher magnetic energy allows smaller size and weight |
| Magnetic couplings (small gap) | Fertile | Adequate magnetic energy at lower cost | Bonded NdFeB | Higher torque is required |
| Magnetic couplings (large gap) | NdFeB | High energy | SmCo | High operating temperature |
| Transport systems | NdFeB | High Energy | SmCo | Availabibry |
| Separators | Ferrite | Adequate magnetic energy at lower cost | NdFeB | High megnetic energy required |
| Magnetic resonance imaging | NdFeB | High energy | Ferrite | Where space is available for a larger volume of material of lower energy |
| Magnetic focusing systems | NdFeB | High energy | SmCo | High operating temperatures or low-temperature coefficient is required |
| Synchronous hysteresis motors | Isotropic FeCrCo | Shape favors fabrication from wrought material | Cobalt steel | Availability |
| Holding devices | Ferrite | Adequate magnetic erergy at low cost | Alnico | Where holding force versus temperature must not vary over wide ranges |
| Ammeters and voltmeters | Alnico | Low temperature coefficient | Not available | . . . |
| Watt-hour meters | Alnico 5 cr 6 | Low temperature coefficient | Not available | . . . |

TABLE 1b

Typical Magnetic Properties of Various Permanent Magnet Materials Including Bonded NdFeB type of magnets

| Designation | $H_c$ kA · $m^{-1}$ | $H_c$ Or | $H_d$ kA · $m^{-1}$ | $H_d$ Or | $B_r$ T | $B_r$ kG | $B_b$ T | $B_b$ kG | $(BH)_{on}$ kJ · $m^{-1}$ | $(BH)_{on}$ MG · Or | $B_d$ T | $B_d$ kG | $H_d$ kA · $m^{-1}$ | $H_d$ Or | Required magnetizing field kA · $m^{-1}$ | Required magnetizing field Or | Permeance coefficient at (BH) | Average recoil permeability, G/Or |
|---|---|---|---|---|---|---|---|---|---|---|---|---|---|---|---|---|---|---|
| 3½ % Cr steel | 5.3 | 66 | . . . | . . . | 0.95 | 9.5 | . . . | . . . | 2.3 | 0.29 | . . . | . . . | . . . | . . . | . . . | . . . | . . . | . . . |
| 6% W steel | 5.9 | 74 | . . . | . . . | 0.95 | 9.5 | . . . | . . . | 2.6 | 0.33 | | | | | | | | |
| 17% Co steel | 14 | 170 | . . . | . . . | 0.95 | 9.5 | . . . | . . . | 5.2 | 0.65 | . . . | . . . | . . . | . . . | . . . | . . . | . . . | . . . |
| 36% Co steel | 19 | 240 | . . . | . . . | 0.975 | 9.75 | . . . | . . . | 7.4 | 0.93 | . . . | . . . | . . . | . . . | . . . | . . . | . . . | . . . |
| Cast Alnico 1 | 35 | 440 | 36 | 455 | 0.71 | 7.1 | 1.05 | 10.5 | 11 | 1.4 | 0.45 | 4.5 | 24 | 305 | 160 | 2.0 | 14 | 6.8 |
| Cast Alnico 2 | 44 | 550 | 46 | 580 | 0.725 | 7.25 | 1.09 | 10.9 | 13 | 1.6 | 0.45 | 4.5 | 28 | 350 | 200 | 2.5 | 12 | 6.4 |
| Cast Alnico 3 | 38 | 470 | 39 | 485 | 0.70 | 7.0 | 1.00 | 10.0 | 11 | 1.4 | 0.43 | 4.3 | 26 | 320 | 200 | 2.5 | 63 | 6.5 |
| Cast Alnico 4 | 58 | 730 | 62 | 770 | 0.535 | 5.35 | 0.86 | 8.6 | 10 | 1.3 | 0.30 | 3.0 | 34 | 420 | 280 | 3.5 | 8.0 | 4.1 |
| Cast Alnico 5 | 50 | 620 | 50 | 625 | 1.25 | 12.5 | 1.35 | 13.5 | 42 | 5.23 | 1.02 | 10.2 | 42 | 525 | 240 | 3.0 | 18 | 4.3 |
| Cast Alnico 5DG | 52 | 650 | 52 | 655 | 1.29 | 12.9 | 1.40 | 14.0 | 49 | 6.1 | 1.05 | 10.5 | 46 | 580 | 280 | 3.5 | 17 | 4.0 |
| Cast Alnico 5-7 | 58 | 730 | 59 | 735 | 1.32 | 13.2 | 1.40 | 14.0 | 59 | 7.4 | 1.15 | 11.5 | 51 | 640 | 280 | 3.5 | 17 | 3.8 |
| Cast Alnico 6 | 60 | 750 | . . . | . . . | 1.05 | 10.5 | 1.30 | 13.0 | 30 | 3.7 | 0.71 | 7.1 | 42 | 525 | 320 | 4.0 | 13 | 5.3 |
| Cast Alnico 7 | 84 | 1,050 | . . . | . . . | 0.857 | 8.57 | 0.945 | 9.45 | 30 | 3.7 | . . . | . . . | . . . | . . . | 400 | 5.0 | 8.2 | . . . |
| Cast Alnico 8 | 130 | 1,600 | 138 | 1,720 | 0.83 | 8.3 | 1.05 | 10.5 | 40 | 5.0 | 0.506 | 5.06 | 76 | 950 | 640 | 8.0 | 5.0 | 3.0 |
| Cast Alnico 9 | 115 | 1,450 | . . . | . . . | 1.05 | 10.5 | . . . | . . . | 68 | 8.5 | . . . | . . . | . . . | . . . | 560 | 7.0 | 7.0 | . . . |
| Cast Alnico 12 | 76 | 950 | . . . | . . . | 0.60 | 6.0 | . . . | . . . | 14 | 1.7 | 0.315 | 3.15 | 43 | 540 | 400 | 5.0 | 5.6 | . . . |
| Sintered Alnico 2 | 42 | 525 | 44 | 545 | 0.67 | 6.7 | 1.10 | 11.0 | 12 | 1.5 | 0.43 | 4.3 | 28 | 345 | 200 | 2.5 | 12 | 6.4 |
| Sintered Alnico 4 | 56 | 700 | 61 | 760 | 0.52 | 5.2 | . . . | . . . | 10 | 1.2 | 0.30 | 3.0 | 32 | 400 | 280 | 3.5 | . . . | 7.5 |
| Sintered Alnico 5 | 48 | 600 | 48 | 605 | 1.04 | 10.4 | 1.205 | 12.05 | 29 | 3.60 | 0.785 | 7.85 | 37 | 465 | 240 | 3.0 | 18 | 4.0 |
| Sintered Alnico 6 | 61 | 760 | 63 | 790 | 0.88 | 8.8 | 1.15 | 11.5 | 22 | 2.75 | 0.55 | 5.5 | 40 | 500 | 320 | 4.0 | 12 | 4.5 |
| Sintered Alnico 8 | 125 | 1,550 | 134 | 1,675 | 0.76 | 7.6 | 0.94 | 9.4 | 36 | 4.5 | 0.46 | 4.6 | 80 | 1,000 | 640 | 8.0 | 5.0 | 2.1 |
| Cunife | 44 | 550 | 44 | 555 | 0.54 | 5.4 | 0.59 | 5.9 | 12 | 1.5 | 0.40 | 4.0 | 26 | 325 | 200 | 2.5 | 12 | 3.7 |
| Bonded ferrite A | 155 | 1,940 | . . . | . . . | 0.214 | 2.14 | . . . | . . . | 8 | 1.0 | 0.116 | 1.16 | . . . | . . . | 960 | 12.0 | 1.3 | 1.1 |
| Bonded ferrite B | 92 | 1,150 | . . . | . . . | 0.14 | 1.4 | . . . | . . . | 3 | 0.4 | . . . | . . . | . . . | . . . | 640 | 8.0 | 1.2 | 1.1 |
| Sintered ferrite 1 | 145 | 1,800 | 276 | 3,450 | 0.22 | 2.2 | . . . | . . . | 8 | 1.0 | 0.11 | 1.1 | 72 | 900 | 800 | 10.0 | 1.2 | 1.2 |
| Sintered ferrite 2 | 175 | 2,200 | 185 | 2,300 | 0.38 | 3.8 | . . . | . . . | 27 | 3.4 | 0.185 | 1.85 | 132 | 1,650 | 800 | 10.0 | 1.1 | 1.1 |
| Sintered ferrite 3 | 240 | 3,000 | 292 | 3,650 | 0.32 | 3.2 | . . . | . . . | 20 | 2.5 | 0.16 | 1.6 | 130 | 1,600 | 800 | 10.0 | 1.1 | 1.1 |
| Sintered ferrite 4 | 175 | 2,200 | 185 | 2,300 | 0.40 | 4.0 | . . . | . . . | 30 | 3.7 | 0.215 | 2.15 | 135 | 1,700 | 960 | 12.0 | 1.2 | 1.05 |
| Sintered ferrite 5 | 250 | 3,150 | 287 | 3,590 | 0.355 | 3.55 | . . . | . . . | 24 | 3.0 | 0.173 | 1.73 | 138 | 1,730 | 1,200 | 15.0 | 1.0 | 1.05 |
| NdFeB (sintered) | 848 | 10,600 | >1,350 | >17,000 | 1.16 | 11.6 | . . . | . . . | 255 | 32 | 0.60 | 6.0 | 425 | 5,300 | >2,000 | >25.0 | 1.13 | . . . |
| Bonded NdFeB | 430 | 5,400 | 720 | 9,000 | 0.69 | 6.9 | . . . | . . . | 76 | 9.5 | 0.315 | 3.15 | 240 | 3,000 | . . . | . . . | 1.05 | . . . |
| Hot-pressed NdFeB | 560 | 7,000 | 1,280 | 16,000 | 0.80 | 8.0 | . . . | . . . | 110 | 13.7 | 0.38 | 3.8 | 295 | 3,700 | . . . | . . . | 1.05 | . . . |

TABLE 1b-continued

Typical Magnetic Properties of Various Permanent Magnet Materials Including Bonded NdFeB type of magnets

| Designation | $H_c$ kA · $m^{-1}$ | $H_c$ Or | $H_d$ kA · $m^{-1}$ | $H_d$ Or | $B_r$ T | $B_r$ kG | $B_h$ T | $B_h$ kG | $(BH)_{on}$ kJ · $m^{-1}$ | $(BH)_{on}$ MG · Or | $B_d$ T | $B_d$ kG | $H_d$ kA · $m^{-1}$ | $H_d$ Or | Required magnetizing field kA · $m^{-1}$ | Required magnetizing field Or | Permeance coefficient at (BH) | Average recoil permeability, G/Or |
|---|---|---|---|---|---|---|---|---|---|---|---|---|---|---|---|---|---|---|
| Hot-formed NdFeB | 880 | 11,000 | 1,20 | 15,000 | 1.20 | 12.0 | . . . | . . . | 274 | 34.2 | 0.59 | 5.9 | 465 | 5,800 | . . . | . . . | 1.05 | . . . |
| Platinum cobalt | 355 | 4,450 | 430 | 5,400 | 0.645 | 6.45 | . . . | . . . | 74 | 9.2 | 0.35 | 3.5 | 215 | 2,700 | 1,600 | 20.0 | 1.2 | 1.2 |
| Cobalt rare earth 1 | 720 | 9,000 | 1,600 | 20,000 | 0.92 | 9.2 | 0.98 | 9.8 | 170 | 21 | . . . | . . . | . . . | . . . | 2,400 | 30.0 | . . . | . . . |
| Cobalt rare earth 2 | 640 | 8,000 | >2,000 | >25,000 | 0.86 | 8.6 | . . . | . . . | 145 | 18 | 0.44 | 4.4 | 330 | 4,100 | 2,400 | 30.0 | . . . | 1.05 |
| Cobalt rare earth 3 | 535 | 6,700 | >1,200 | >15,000 | 0.80 | 8.0 | . . . | . . . | 120 | 15 | 0.40 | 4.0 | 295 | 3,700 | 2,400 | 30.0 | . . . | 1.1 |
| Cobalt rare earth 4 | 640 | 8,000 | >640 | >8,000 | 1.13 | 11.3 | . . . | . . . | 240 | 30 | 0.60 | 6.0 | 400 | 5,000 | >1,600 | >20.0 | 1.2 | . . . |

For nominal compositions, see Table 1: for mechanical and physical properties, see Table 3

TABLE 2

CDC Higher Pressure Compacted Permanent Magnets

| Sample #: | Date: | Description: | Peak Load (tsi) | Green Density (g/cm$^3$) | Die Geometry | ID (in) | OD (in) | Height (in) | Mass (g) | Spring back from die; ID (%) | Spring back from die OD (%) | Aspect Ratio (ht. / wall) |
|---|---|---|---|---|---|---|---|---|---|---|---|---|
| 51 | Jul. 5, 2001 | Nd—Fe—B | 154.0 | 6.0031 | Tensile | | | 0.3148 | 30.968 | | | |
| 52 | Jul. 6, 2001 | Fe—Co—V | 152.0 | 6.8090 | Tensile | | | 0.2856 | 31.867 | | | |
| 55 | Jul. 9, 2001 | Nd—Fe—B + Cu 5% | 159.0 | 6.1507 | Tensile | | | 0.3083 | 31.074 | | | |
| 56 | Jul. 9, 2001 | Fe—Co—V + Cu 5% | 151.0 | 6.9397 | Tensile | | | 0.2803 | 31.876 | | | |
| 57 | Jul. 9, 2001 | Fe—Co—V | 149.0 | 6.7797 | Tensile | | | 0.2873 | 31.919 | | | |
| 84 | Jul. 24, 2001 | Nd—Fe—B + .5%ZnSt | 152.0 | 5.9700 | Tensile | | | 0.3173 | 31.042 | | | |
| 85 | Jul. 25, 2001 | Fe—Co—V + .5%ZnSt | 151.0 | 6.8160 | Tensile | | | 0.2851 | 31.844 | | | |
| 86 | Jul. 26, 2001 | Nd—Fe—B | 168.0 | 5.8578 | 1/2" Cyl | | 0.5030 | 0.6400 | 12.208 | | 0.60 | |
| 87 | Jul. 26, 2001 | Nd—Fe—B | 218.9 | 6.0607 | 1/2" Cyl | | 0.5040 | 0.6030 | 11.948 | | 0.80 | |
| 88 | Jul. 26, 2001 | Nd—Fe—B | 218.9 | 6.1117 | 1/2" Cyl | | 0.5035 | 0.3070 | 6.122 | | 0.70 | |
| 89 | Jul. 27, 2001 | Fe—Co—V | 208.8 | 6.8980 | 1/2" Cyl | | 0.5050 | 0.2760 | 6.249 | | 1.00 | |
| 154 | Sep. 7, 2001 | Magnequench MQU-F42 | 146.6 | 6.4106 | 1/2" Cyl | | 0.5050 | 0.5820 | 12.246 | | 1.00 | |
| 155 | Sep. 12, 2001 | Magnequench MQU-F42 | 146.6 | 6.4918 | 1/2" Cyl | | 0.5050 | 0.5750 | 12.252 | | 1.00 | |
| 156 | Sep. 12, 2001 | Magnequench MQU-F42 | 198.1 | 6.4733 | 1/2" Cyl | | 0.5030 | 0.5800 | 12.226 | | 0.60 | |
| 157 | Sep. 13, 2001 | Magnequench MQP-B | 139.5 | 6.5188 | 1/2" Cyl | | 0.5040 | 0.5740 | 12.233 | | 0.80 | |
| 158 | Sep. 13, 2001 | Magnequench MQP-B | 198.1 | 6.6678 | 1/2" Cyl | | 0.5040 | 0.5670 | 12.360 | | 0.80 | |
| 159 | Sep. 13, 2001 | Magnequench MQP-B | 256.6 | 6.7441 | 1/2" Cyl | | 0.5040 | 0.5560 | 12.259 | | 0.80 | |
| 160 | Sep. 14, 2001 | Magnequench MQP-B | 146.6 | 6.5501 | 1/2" Cyl | | 0.5050 | 0.5710 | 12.276 | | 1.00 | |
| 161 | Sep. 14, 2001 | Magnequench MQP-B | 139.5 | 6.5206 | 1/2" Cyl | | 0.5035 | 0.2830 | 6.021 | | 0.70 | |
| 162 | Sep. 18, 2001 | Magnequench MQP-B (270 mesh) | 139.5 | 6.3618 | 1/2" Cyl | | 0.5050 | 0.5900 | 12.320 | | 1.00 | |
| 163 | Sep. 18, 2001 | Magnequench MQP-B (270 mesh) | 139.5 | 6.3307 | 1/2" Cyl | | 0.5050 | 0.6070 | 12.613 | | 1.00 | |
| 541 | Jan. 6, 2003 | FeNi 30% NiFe2O4 | 149.3 | 5.3570 | Ring | 0.3210 | 0.5050 | 0.2360 | 2.473 | 0.31 | 1.00 | 2.57 |
| 542 | Jan. 6, 2003 | FeCo1209 NiFe2O4 | 144.6 | | 1/2" Cyl | | | | | | | |
| 543 | Jan. 7, 2003 | FeCo1209 SiO2 | 150.2 | 2.4840 | 1/2" Cyl | | 0.5040 | 0.1900 | 1.543 | | 0.80 | |
| 544 | Jan. 7, 2003 | FeCo1209 SiO2 | 146.6 | 2.4733 | 1/2" Cyl | | 0.5040 | 0.2440 | 1.973 | | 0.80 | |
| 549 | Jan. 20, 2003 | FeNi - 30% NiFe2O4 | 143.2 | | Ring | | | | | | | |
| | Jan. 20, 2003 | FeNi - 30% NiFe2O4 2nd shot | 136.3 | | Ring | | | | | | | |
| | Jan. 20, 2003 | FeNi - 30% NiFe2O4 3rd shot | 136.3 | 5.1503 | Ring | 0.3215 | 0.5040 | 0.2930 | 2.926 | 0.47 | 0.80 | 3.21 |
| 550 | Jan. 21, 2003 | FeNi - 30% NiFe2O4 | 149.3 | | Ring | | | | | | | |
| | Jan. 21, 2003 | FeNi - 30% NiFe2O4 2nd shot | 133.7 | | Ring | | | | | | | |
| | Jan. 21, 2003 | FeNi - 30% NiFe2O4 3rd shot | 136.3 | 5.1683 | Ring | 0.3215 | 0.5045 | 0.2370 | 2.383 | 0.47 | 0.90 | 2.59 |
| 551 | Jan. 21, 2003 | FeNi - SiO2 | 149.3 | | Ring | | | | | | | |
| | Jan. 21, 2003 | FeNi - SiO2 2nd shot | 130.3 | | Ring | | | | | | | |
| | Jan. 21, 2003 | FeNi - SiO2 3rd shot | 130.3 | 5.8077 | Ring | 0.3215 | 0.5040 | 0.2030 | 2.286 | 0.47 | 0.80 | 2.22 |
| 552 | Jan. 21, 2003 | FeCo1223 - SiO2 | 149.3 | | Ring | | | | | | | |
| | Jan. 21, 2003 | FeCo1223 - SiO2 2nd shot | 133.7 | | Ring | | | | | | | |
| | Jan. 21, 2003 | FeCo1223 - SiO2 3rd shot | 130.3 | 2.5773 | Ring | 0.3220 | 0.5045 | 0.2960 | 1.481 | 0.63 | 0.90 | 3.24 |
| 576 | Apr. 30, 2003 | SmCo5 + 15 wt% Fe (Sample2) | 141.1 | 7.0636 | 1/2" Cyl | 0.5040 | 0.2900 | 6.697 | 0.80 | | | |
| 577 | Apr. 30, 2003 | SmCo5 + 15 wt% Fe (Sample1) | 144.8 | 7.1566 | 1/2" Cyl | 0.5040 | 0.3350 | 7.838 | 0.80 | | | |
| 578 | Jun. 11, 2003 | FeCo—SiO2 | | | Ring | | | | | | | |
| | Jun. 11, 2003 | FeCo—SiO2 2nd shot | | | Ring | | | | | | | |
| 579 | Jun. 11, 2003 | Fe—Fe3O4 | | | Ring | | | | | | | |
| | Jun. 11, 2003 | Fe—Fe3O4 2nd shot | | 4.7328 | Ring | 0.3200 | 0.5100 | 0.2300 | 2.190 | 0.00 | 2.00 | 2.42 |
| 580 | Jun. 11, 2003 | FeNi—S1O2 | | | Ring | | | | | | | |
| | Jun. 11, 2003 | FeNi—S1O2 | | 6.1455 | Ring | 0.3200 | 0.5000 | 0.1900 | 2.250 | 0.00 | 0.00 | 2.11 |
| 581 | Jul. 1, 2003 | Zeng 2 [Sm(CoFeCuZr) 7.5 + 20 wt%Fe] | 168.0 | 6.9013 | 1/2" Cyl | 0.5000 | 0.2200 | 5.050 | 0.00 | | | |
| 582 | Jul. 1, 2003 | Alex [Pr7 Tb1 Fe87 Nb0.5 Z0r.5 B4] | 169.6 | 6.0913 | 1/2" Cyl | 0.5000 | 0.3300 | 6.490 | 0.00 | | | |
| 583 | Jul. 1, 2003 | Dilara [Fe50Cu50] | 172.1 | 7.4932 | 1/2" Cyl | 0.5000 | 0.2700 | 6.580 | 0.00 | | | |
| 585 | Jul. 3, 2003 | s24 [SmCo5] | 153.4 | 6.3796 | 1/2" Cyl | 0.5000 | 0.1300 | 2.750 | 0.00 | | | |
| 586 | Jul. 3, 2003 | sf24 [SmCo5 + 15 atomic%Fe] | 153.5 | 6.2450 | 1/2" Cyl | 0.5000 | 0.1500 | 2.940 | 0.00 | | | |
| 587 | Jul. 3, 2003 | s217f24 [Sm2Co17 + 15 atomic%Fe] | 148.9 | 6.3159 | 1/2" Cyl | 0.5000 | 0.1300 | 2.750 | 0.00 | | | |
| 736 | Dec. 2, 2003 | CMU #sm111403 [Sm2Co17:Fe(20% atomic) (fine pwdr; size~few microns)] | 166.8 | | 1/2" Cyl | | | | | | | |

TABLE 2-continued

CDC Higher Pressure Compacted Permanent Magnets

| Sample #: | Date: | Description: | Peak Load (tsi) | Green Density (g/cm$^3$) | Die Geometry | ID (in) | OD (in) | Height (in) | Mass (g) | Spring back from die; ID (%) | Spring back from die OD (%) | Aspect Ratio (ht. / wall) |
|---|---|---|---|---|---|---|---|---|---|---|---|---|
| 737 | Dec. 2, 2003 | CMU #sm111803 [Sm2Co17:Fe(20% atomic) (coarse pwdr; size~150 microns)] | 163.5 | | 1/2" Cyl | | | | | | | |
| 738 | Dec. 2, 2003 | CMU #sm111903 [SmCo5] | 166.4 | | 1/2" Cyl | | | | | | | |
| 753 | Dec. 9, 2003 | Uni of Del Sample #1 [FeCoSiO2Nov18d] | 153.8 | 3.5779 | Ring | 0.3210 | 0.5040 | 0.2510 | 1.745 | 0.31 | 0.80 | 2.74 |
| 754 | Dec. 9, 2003 | Uni of Del Sample #2 [FeNi(100 nm)/S102] | 156.9 | 5.4495 | Ring | 0.3210 | 0.5040 | 0.2750 | 2.912 | 0.31 | 0.80 | 3.01 |
| 755 | Dec. 9, 2003 | Uni of Del Sample #1 [FeCoSiO2Nov18d] | 163.2 | | 1/2" Cyl | | | | | | | |
| 756 | Dec. 10, 2003 | Uni of Del Sample #3 [FeNi(100 nm)/SiO2 (3nm)] | 160.1 | 5.2700 | 1/2" Cyl | 0.5040 | 0.1505 | 2.593 | 0.80 | | | |
| 791 | Feb. 5, 2004 | Uni of Del Sample #1 [FeCoSiO2 10%Fe] | 166.1 | 3.5653 | Ring | 0.3330 | 0.5200 | 0.1910 | 1.398 | 4.06 | 4.00 | 2.04 |
| 792 | Feb. 5, 2004 | Uni of Del Sample #3 [FeCoSiO2 15%Fe] | 166.7 | 3.7325 | Ring | 0.3250 | 0.5100 | 0.2020 | 1.499 | 1.56 | 2.00 | 2.18 |
| 793 | Feb. 5, 2004 | Uni of Del Sample #4 [FeNi(100 nm)/SiO2 (3 nm) 15%Fe] | 166.9 | 5.6246 | Ring | 0.3230 | 0.5050 | 0.1815 | 1.980 | 0.94 | 1.00 | 1.99 |
| 794 | Feb. 23, 2004 | Uni of Del Sample [Fe/SiO2] | 163.5 | 4.8468 | Ring | 0.3210 | 0.5025 | 0.1390 | 1.296 | 0.31 | 0.50 | 1.53 |
| 795 | Feb. 23, 2004 | Uni of Del Sample [Fe/SiO2] | 162.9 | 5.6363 | Ring | 0.3210 | 0.5025 | 0.1650 | 1.789 | 0.31 | 0.50 | 1.82 |
| 941 | Aug. 26, 2004 | CMU SMO811a [Sm2Co17 + 20 atomic%Fe] | 177.7 | | 1/2" Cyl | | | | | | | |
| 942 | Aug. 26, 2004 | CMU SMO811b [Sm2Co17 + 20 atomic%Fe] | 180.6 | | 1/2" Cyl | | | | | | | |
| 943 | Aug. 26, 2004 | CMU SMO811c [Sm2Co17 + 20 atomic%Fe] | 174.9 | | 1/2" Cyl | | | | | | | |

TABLE 3

CDC Higher Pressure Compacted Bonded Neo-Magnets

| Sample #: | Date Pressed | Description: | Green Density (g/cm$^3$) | Mass: (g) | ID/ width (in) | OD/ length (in) | Height (in) | Die Geometry: | Change from die ID/ width (%) | Change from die OD/ length (%) | CDC Pressure (tsi) |
|---|---|---|---|---|---|---|---|---|---|---|---|
| 2650 | Dec. 14, 2009 | MPQ-B | 6.3415 | 13.988 | | 0.5780 | 0.5130 | .575 cyl | | 0.52 | 90.9 |
| 2651 | Dec. 14, 2009 | MQLP-B (-80M) | 6.1889 | 14.030 | | 0.5820 | 0.5200 | .575 cyl | | 1.22 | 88.1 |
| 2652 | Dec. 14, 2009 | MQLP-B (-80M) | 6.4342 | 13.997 | | 0.5820 | 0.4990 | .575 cyl | | 1.22 | 142.4 |
| 2653 | Dec. 14, 2009 | MPQ-B | 6.6094 | 14.022 | | 0.5800 | 0.4900 | .575 cyl | | 0.87 | 141.8 |
| 2654 | Dec. 14, 2009 | MQLP-B (-80M) | 6.4295 | 14.030 | | 0.5800 | 0.5040 | .575 cyl | | 0.87 | 141.8 |
| 2655 | Dec. 14, 2009 | MQLP-B (-80M) | 6.4297 | 14.051 | | 0.5810 | 0.5030 | .575 cyl | | 1.04 | 135.6 |
| 2656 | Dec. 14, 2009 | MQLP-B (-80M) | 6.4177 | 14.073 | | 0.5820 | 0.5030 | .575 cyl | | 1.22 | 137.7 |
| 2657 | Dec. 14, 2009 | MQLP-B (-80M) | 6.1326 | 14.073 | | 0.5850 | 0.5210 | .575 cyl | | 1.74 | 65.4 |
| 2658 | Dec. 15, 2009 | MQLP-B (-80M) | 6.1234 | 14.025 | | 0.5850 | 0.5200 | .575 cyl | | 1.74 | 83.8 |
| 2659 | Dec. 15, 2009 | MQLP-B (-80M) | 6.1479 | 14.033 | | 0.5840 | 0.5200 | .575 cyl | | 1.57 | 79.5 |
| 2660 | Dec. 15, 2009 | MQLP-B (-80M) | 6.1462 | 14.002 | | 0.5840 | 0.5190 | .575 cyl | | 1.57 | 70.9 |
| 2661 | Dec. 15, 2009 | MQLP-B (-80M) | 6.1728 | 13.998 | | 0.5835 | 0.5175 | .575 cyl | | 1.48 | 79.5 |
| 2662 | Dec. 15, 2009 | MQLP-B (-80M) | 6.1607 | 14.014 | | 0.5830 | 0.5200 | .575 cyl | | 1.39 | 83.1 |
| 2663 | Dec. 15, 2009 | MQLP-B (-80M) | 6.1761 | 13.995 | | 0.5830 | 0.5180 | .575 cyl | | 1.39 | 70.9 |
| 2664 | Dec. 15, 2009 | MQLP-B (-80M) | 6.3813 | 14.125 | | 0.5830 | 0.5060 | .575 cyl | | 1.39 | 149.9 |
| 2665 | Dec. 15, 2009 | MQLP-B (-80M) | 6.3904 | 14.121 | | 0.5825 | 0.5060 | .575 cyl | | 1.30 | 149.5 |
| 2666 | Dec. 15, 2009 | MQLP-B (-80M) | 6.3885 | 14.155 | | 0.5830 | 0.5065 | .575 cyl | | 1.39 | 142.4 |
| 2667 | Dec. 15, 2009 | MQLP-B (-80M) | 6.3805 | 14.113 | | 0.5825 | 0.5065 | .575 cyl | | 1.30 | 119.5 |
| 2668 | Dec. 15, 2009 | MIOLP-B (-80M) | 6.4117 | 14.126 | | 0.5825 | 0.5045 | .575 cyl | | 1.30 | 158.6 |
| 2669 | Dec. 15, 2009 | MQLP-B (-80M) | 6.3731 | 14.159 | | 0.5835 | 0.5070 | .575 cyl | | 1.48 | 126.5 |
| 2670 | Dec. 15, 2009 | MQLP-B (-80M) | 6.3898 | 14.116 | | 0.5830 | 0.5050 | .575 cyl | | 1.39 | 136.3 |

TABLE 3-continued

CDC Higher Pressure Compacted Bonded Neo-Magnets

| Sample #: | Date Pressed | Description: | Green Density (g/cm$^3$) | Mass: (g) | ID/ width (in) | OD/ length (in) | Height (in) | Die Geom-etry: | Change from die ID/ width (%) | Change from die OD/ length (%) | CDC Pressure (tsi) |
|---|---|---|---|---|---|---|---|---|---|---|---|
| 2671 | Dec. 15, 2009 | MQLP-B (-80M) | 6.4017 | 14.118 | | 0.5825 | 0.5050 | .575 cyl | | 1.30 | 139.7 |
| 2672 | Dec. 16, 2009 | MQLP-B (-80M) | 6.1210 | 14.028 | | 0.5835 | 0.5230 | .575 cyl | | 1.48 | 70.2 |
| 2673 | Dec. 16, 2009 | MQLP-B (-80M) | 6.1611 | 14.015 | | 0.5830 | 0.5200 | .575 cyl | | 1.39 | 72.7 |
| 2674 | Dec. 16, 2009 | MQLP-B (-80M) | 6.1485 | 14.040 | | 0.5830 | 0.5220 | .575 cyl | | 1.39 | 80.2 |
| 2675 | Dec. 16, 2009 | MQLP-B (-80M) | 6.1845 | 14.035 | | 0.5840 | 0.5170 | .575 cyl | | 1.57 | 89.1 |
| 2676 | Dec. 16, 2009 | MQLP-B (-80M) | 6.3849 | 25.216 | 0.3470 | 3.5520 | 0.2410 | Tensile | 1.17 | 0.65 | 82.6 |
| 2677 | Dec. 16, 2009 | MQLP-B (-80M) | 6.5492 | 26.616 | 0.3470 | 3.5520 | 0.2480 | Tensile | 1.17 | 0.65 | 130.9 |
| 2678 | Dec. 16, 2009 | MPQ-B | 6.8440 | 27.029 | 0.3470 | 3.5530 | 0.2410 | Tensile | 1.17 | 0.68 | 155.4 |
| 2821 | Jan. 27, 2010 | CDC-H PM1-2 | 6.4643 | 13.986 | | 0.5810 | 0.4980 | .575 cyl | | 1.04 | 152.4 |
| 2822 | Jan. 27, 2010 | CDC-HPM1-1 | 6.4961 | 14.083 | | 0.5810 | 0.4990 | .575 cyl | | 1.04 | 138.6 |
| 2823 | Jan. 27, 2010 | CDC-H PM1-3 | 6.3671 | 13.997 | | 0.5810 | 0.5060 | .575 cyl | | 1.04 | 143.8 |
| 2824 | Jan. 27, 2010 | CDC-HPM1-4 | 6.3049 | 14.052 | | 0.5810 | 0.5130 | .575 cyl | | 1.04 | 155.2 |
| 2825 | Jan. 27, 2010 | C DC-H PM1-5 | 6.0069 | 14.223 | | 0.5810 | 0.5450 | .575 cyl | | 1.04 | 160.4 |
| 2826 | Jan. 27, 2010 | CDC-HPM1-6 | 6.6381 | 14.107 | | 0.5805 | 0.4900 | .575 cyl | | 0.96 | 11.8 |
| 2827 | Jan. 28, 2010 | CDC-HPM1-1 | 6.5296 | 14.014 | | 0.5810 | 0.4940 | .575 cyl | | 1.04 | 145.6 |
| 2828 | Jan. 28, 2010 | CDC-HPM1-1 | 6.3949 | 14.086 | | 0.5810 | 0.5070 | .575 cyl | | 1.04 | 137.4 |
| 2829 | Jan. 28, 2010 | CDC-HPM2-1 | 6.4586 | 14.100 | | 0.5810 | 0.5025 | .575 cyl | | 1.04 | 136.5 |
| 2830 | Jan. 28, 2010 | CDC-HPM2-1 | 6.5786 | 14.062 | | 0.5810 | 0.4920 | .575 cyl | | 1.04 | 127.2 |
| 2831 | Jan. 28, 2010 | CDC-HPM1-2 | 6.4224 | 14.021 | | 0.5810 | 0.5025 | .575 cyl | | 1.04 | 150.2 |
| 2832 | Jan. 28, 2010 | CDC-H PM1-3 | 6.4086 | 13.977 | | 0.5810 | 0.5020 | .575 cyl | | 1.04 | 147.9 |
| 2833 | Jan. 28, 2010 | CDC-HPM1-4 | 6.3322 | 14.113 | | 0.5810 | 0.5130 | .575 cyl | | 1.04 | 143.1 |
| 2834 | Jan. 29, 2010 | CDC-HPM1-5 | 6.1349 | 14.073 | | 0.5810 | 0.5280 | .575 cyl | | 1.04 | 157.4 |
| 2835 | Jan. 29, 2010 | CDC-HPM2-1 | 6.5074 | 14.037 | | 0.5810 | 0.4965 | .575 cyl | | 1.04 | 150.2 |
| 2836 | Jan. 29, 2010 | CDC-HPM2-1 | 6.7173 | 27.079 | 0.3465 | 3.5525 | 0.2460 | Tensile | 1.02 | 0.67 | 137.8 |
| 2837 | Jan. 29, 2010 | CDC-H PM1-1 | 6.6591 | 27.099 | 0.3480 | 3.5520 | 0.2483 | Tensile | 1.46 | 0.65 | 145.7 |
| 2838 | Jan. 29, 2010 | CDC-H PM1-2 | 6.6345 | 27.017 | 0.3480 | 3.5520 | 0.2485 | Tensile | 1.46 | 0.65 | 144.1 |
| 2839 | Jan. 29, 2010 | CDC-H P M1-3 | 6.5023 | 26.976 | 0.3480 | 3.5520 | 0.2532 | Tensile | 1.46 | 0.65 | 144.1 |
| 2840 | Feb. 1, 2010 | CDC-H PM1-4 | 6.4460 | 26.971 | 0.3475 | 3.5510 | 0.2553 | Tensile | 1.31 | 0.62 | 160.6 |
| 2841 | Feb. 1, 2010 | CDC-H PM1-4 | 6.1894 | 26.844 | 0.3475 | 3.5500 | 0.2647 | Tensile | 1.31 | 0.60 | 149.0 |
| 2842 | Feb. 1, 2010 | CDC-HPM3-1 | 6.5927 | 27.009 | 0.3485 | 3.5530 | 0.2500 | Tensile | 1.60 | 0.68 | 148.8 |
| 2843 | Feb. 1, 2010 | CDC-HPM3-2 | 6.5556 | 27.018 | 0.3480 | 3.5500 | 0.2515 | Tensile | 1.46 | 0.60 | 139.2 |
| 2844 | Feb. 2, 2010 | CDC-HPM3-3 | 6.4709 | 27.199 | 0.3480 | 3.5510 | 0.2565 | Tensile | 1.46 | 0.62 | 152.9 |
| 2845 | Feb. 2, 2010 | CDC-HPM3-4 | 6.4483 | 27.069 | 0.3480 | 3.5520 | 0.2562 | Tensile | 1.46 | 0.65 | 144.1 |
| 2846 | Feb. 2, 2010 | CDC-HPM3-5 | 6.2205 | 26.792 | 0.3480 | 3.5520 | 0.2628 | Tensile | 1.46 | 0.65 | 144.3 |
| 2847 | Feb. 2, 2010 | CDC-HPM3-6 | 6.6580 | 26.949 | 0.3485 | 3.5530 | 0.2470 | Tensile | 1.60 | 0.68 | 138.7 |
| 2848 | Feb. 2, 2010 | | 6.4931 | 14.000 | | 0.5800 | 0.4980 | .575 cyl | | 0.87 | 148.6 |
| 2849 | Feb. 2, 2010 | CDC-HPM3-1 | 6.4335 | 13.983 | | 0.5800 | 0.5020 | .575 cyl | | 0.87 | 135.4 |
| 2850 | Feb. 3, 2010 | CDC-HPM3-2 | 6.4560 | 14.032 | | 0.5800 | 0.5020 | .575 cyl | | 0.87 | 170.4 |
| 2851 | Feb. 3, 2010 | CDC-HPM3-3 | 6.3228 | 13.934 | | 0.5800 | 0.5090 | .575 cyl | | 0.87 | 161.8 |
| 2852 | Feb. 3, 2010 | CDC-HPM3-4 | 6.2814 | 13.734 | | 0.5800 | 0.5050 | .575 cyl | | 0.87 | 153.4 |
| 2853 | Feb. 3, 2010 | CDC-HPM3-5 | 6.1521 | 13.984 | | 0.5800 | 0.5250 | .575 cyl | | 0.87 | 162.4 |
| 2917 | Mar. 5, 2010 | MQP-B | 6.2008 | 3.940 | 0.3200 | 0.5020 | 0.3300 | 1/2" Ring | 0.00 | 0.40 | 145.1 |
| 2918 | Mar. 5, 2010 | MQP-B | 6.1935 | 3.995 | 0.3200 | 0.5020 | 0.3350 | 1/2" Ring | 0.00 | 0.40 | 150.2 |
| 2920 | Mar. 5, 2010 | MQP-B | 6.2198 | 2.000 | 0.3200 | 0.5020 | 0.1670 | 1/2" Ring | 0.00 | 0.40 | 155.8 |
| 2921 | Mar. 5, 2010 | MQP-B2 | 6.2028 | 3.995 | 0.3200 | 0.5020 | 0.3345 | 1/2" Ring | 0.00 | 0.40 | 142.5 |
| 2922 | Mar. 5, 2010 | MQP-B2 | 6.1308 | 3.990 | 0.3200 | 0.5020 | 0.3380 | 1/2" Ring | 0.00 | 0.40 | 142.5 |
| 2931 | Mar. 9, 2010 | MQP-B | 6.6629 | 14.020 | | 0.5800 | 0.4860 | .575 cyl | | 0.87 | 148.4 |
| 2932 | Mar. 9, 2010 | MQP-B | 6.6206 | 14.017 | | 0.5800 | 0.4890 | .575 cyl | | 0.87 | 145.9 |
| 2933 | Mar. 9, 2010 | MQP-B | 6.6290 | 14.006 | | 0.5800 | 0.4880 | .575 cyl | | 0.87 | 148.8 |
| 2934 | Mar. 9, 2010 | MQP-B | 6.6167 | 14.023 | | 0.5800 | 0.4895 | .575 cyl | | 0.87 | 141.1 |
| 2935 | Mar. 10, 2010 | MQP-B | 6.6468 | 14.015 | | 0.5800 | 0.4870 | .575 cyl | | 0.87 | 154.9 |
| 2936 | Mar. 10, 2010 | MQP-B | 6.6419 | 14.019 | | 0.5800 | 0.4875 | .575 cyl | | 0.87 | 154.9 |
| 2937 | Mar. 10, 2010 | MQP-B2 | 6.6212 | 14.004 | | 0.5800 | 0.4885 | .575 cyl | | 0.87 | 155.8 |
| 2938 | Mar. 10, 2010 | MQP-B2 | 6.6206 | 14.017 | | 0.5800 | 0.4890 | .575 cyl | | 0.87 | 150.6 |
| 2939 | Mar. 10, 2010 | MOP-B2 | 6.6057 | 14.014 | | 0.5800 | 0.4900 | .575 cyl | | 0.87 | 154.5 |
| 2940 | Mar. 10, 2010 | MQP-B2 | 6.6126 | 14.000 | | 0.5800 | 0.4890 | .575 cyl | | 0.87 | 154.7 |
| 2941 | Mar. 10, 2010 | MQP-B2 | 6.6014 | 14.005 | | 0.5800 | 0.4900 | .575 cyl | | 0.87 | 154.5 |
| 2942 | Mar. 10, 2010 | MQP-B | 6.5894 | 14.008 | | 0.5800 | 0.4910 | .575 cyl | | 0.87 | 155.4 |

TABLE 4

CDC Compacted Magnetic Sample Data in the As-Pressed Condition

| Sample #: | Description: | Cured Density ($g/cm^3$) | Mass: (g) | OD (in) | Height (in) | Fill Ratio | Change from die OD (%) | CDC Compaction Pressure |
|---|---|---|---|---|---|---|---|---|
| 2656 | MQLP-B | 6.4177 | 14.073 | 0.5820 | 0.5030 | (1.9 vib) | 1.22 | High |
| 2664 | MQLP-B | 6.3813 | 14.125 | 0.5830 | 0.5060 | (1.9 vib) | 1.39 | High |
| 2665 | MQLP-B | 6.3904 | 14.121 | 0.5825 | 0.5060 | (1.9 vib) | 1.30 | High |
| 2666 | MQLP-B | 6.3885 | 14.155 | 0.5830 | 0.5065 | (1.9 vib) | 1.39 | High |
| 2672 | MQLP-B | 6.1210 | 14.028 | 0.5835 | 0.5230 | (1.8 vib) | 1.48 | Low |
| 2673 | MQLP-B | 6.1611 | 14.015 | 0.5830 | 0.5200 | (1.9 vib) | 1.39 | Low |
| 2674 | MQLP-B | 6.1485 | 14.040 | 0.5830 | 0.5220 | (1.9 vib) | 1.39 | Low |
| 2675 | MQLP-B | 6.1845 | 14.035 | 0.5840 | 0.5170 | (1.9 vib) | 1.57 | Low |

Die Geometry; 0.575" OD Cylinder die

TABLE 5

CDC Compacted and Thermally Cured Samples

| Sample #: | Description: | Cured Density ($g/cm^3$) | Mass: (g) | OD (in) | Height (in) | Change from die OD (%) | Change from green height (%) | Change in mass (g) | CDC Compaction Pressure |
|---|---|---|---|---|---|---|---|---|---|
| 2656 | MQLP-B | 6.3851 | 14.078 | 0.5830 | 0.5040 | 1.39 | 0.20 | 0.0046 | High |
| 2664 | MQLP-B | 6.3842 | 14.132 | 0.5830 | 0.5060 | 1.39 | 0.00 | 0.0065 | High |
| 2665 | MQLP-B | 6.3700 | 14.128 | 0.5830 | 0.5070 | 1.39 | 0.20 | 0.0069 | High |
| 2666 | MQLP-B | 6.3594 | 14.160 | 0.5830 | 0.5090 | 1.39 | 0.49 | 0.0050 | High |
| 2672 | MQLP-B | 6.1015 | 14.037 | 0.5835 | 0.5250 | 1.48 | 0.38 | 0.0088 | Low |
| 2673 | MQLP-B | 6.1279 | 14.028 | 0.5840 | 0.5215 | 1.57 | 0.29 | 0.0127 | Low |
| 2674 | MQLP-B | 6.1113 | 14.046 | 0.5835 | 0.5245 | 1.48 | 0.48 | 0.0060 | Low |
| 2675 | MQLP-B | 6.1350 | 14.049 | 0.5855 | 0.5190 | 1.83 | 0.39 | 0.0135 | Low |

TABLE 6

Select Properties of Higher Density Bonded Neo Magnets

| CDC Sample | Density (g/cc) | Br (kG) | HcJ (kOe) | (8H)max (MGOe) |
|---|---|---|---|---|
| CDC-2666-MQLP-B | 6.36 | 7.51 | 9.1 | 11.6 |
| CDC-2669-MQLP-B | 6.349 | 7.314 | 9.116 | 10.9 |

TABLE 7

UTRON Kinetics Combustion Driven Compaction (CDC) on MOLP-B

| | | | | | Coil 38468 | | |
|---|---|---|---|---|---|---|---|
| | OD (cm) | Height (cm) | Mass (g) | Density (g/cc) | Br (kG) | Hci (kOe) | (BH) max (MGOe) |
| CDC Low Load 2672 | 1.482 | 1.334 | 14.037 | 6.10 | 7.14 | 8.9 | 10.3 |
| CDC Low Load 2673 | 1.483 | 1.325 | 14.028 | 6.13 | 7.14 | 8.9 | 10.4 |
| CDC Low Load 2674 | 1.482 | 1.332 | 14.046 | 6.11 | 7.12 | 9.0 | 10.4 |
| CDC Low Load 2675 | 1.487 | 1.318 | 14.049 | 6.14 | 7.15 | 8.9 | 10.4 |
| CDC Low Load | 1.484 | 1.327 | 14.040 | 6.12 | 7.14 | 8.9 | 10.4 |
| CDC High Load 2656 | 1.481 | 1.280 | 14.078 | 6.39 | 7.50 | 9.1 | 11.5 |
| CDC High Load 2664 | 1.481 | 1.285 | 14.132 | 6.38 | 7.51 | 9.1 | 11.6 |
| CDC High Load 2665 | 1.481 | 1.288 | 14.128 | 6.37 | 7.52 | 9.2 | 11.6 |
| CDC High Load 2666 | 1.481 | 1.293 | 14.160 | 6.36 | 7.51 | 9.1 | 11.6 |
| CDC High Load | 1.481 | 1.287 | 14.125 | 6.37 | 7.51 | 9.1 | 11.6 |

TABLE 8

UTRON Kinetics Combustion Driven Compaction (CDC) Samples

| | | | | | Coil 35038 | | | Helmholtz Coil | |
|---|---|---|---|---|---|---|---|---|---|
| Sample ID | OD (cm) | Height (cm) | Mass (g) | Density (g/cc) | Br (kG) | Hci (kOe) | (BH) max (MGOe) | MMT | Bdi ~ PC3 |
| CDC #2830 HPM (2-1) | 1.480 | 1.259 | 14.078 | 6.51 | 7.69 | 9.0 | 11.6 | 2.535 | 7.19 |
| CDC #2831 HPM (1-2) | 1.476 | 1.279 | 14.022 | 6.41 | 7.50 | 9.1 | 11.6 | 2.557 | 7.17 |
| CDC #2832 HPM (1-3) | 1.477 | 1.280 | 13.979 | 6.37 | 7.38 | 9.0 | 11.2 | 2.545 | 7.12 |
| CDC #2833 HPM (1-4) | 1.477 | 1.312 | 14.111 | 6.28 | 7.36 | 9.0 | 11.1 | 2.563 | 7.00 |
| CDC #2834 HPM (1-5) | 1.474 | 1.351 | 14.072 | 6.10 | 7.08 | 9.0 | 10.4 | 2.536 | 6.74 |
| CDC #2835 HPM (2-1) | 1.474 | 1.256 | 14.047 | 6.55 | 7.73 | 9.0 | 11.6 | 2.511 | 7.18 |
| CDC #2848 HPM (3-6) | 1.476 | 1.256 | 14.044 | 6.54 | 7.69 | 9.3 | 11.0 | 2.508 | 7.16 |
| CDC #2849 HPM (3-1) | 1.474 | 1.281 | 13.982 | 6.39 | 7.57 | 9.3 | 11.6 | 2.557 | 7.17 |
| CDC #2850 HPM (3-2) | 1.477 | 1.270 | 14.033 | 6.45 | 7.63 | 9.3 | 11.7 | 2.565 | 7.23 |
| CDC #2851 HPM (3-3) | 1.474 | 1.303 | 13.920 | 6.26 | 7.38 | 9.4 | 11.3 | 2.556 | 7.05 |
| CDC #2852 HPM (3-4) | 1.477 | 1.278 | 13.728 | 6.27 | 7.41 | 9.4 | 11.4 | 2.523 | 7.07 |
| CDC #2853 HPM (3-5) | 1.474 | 1.342 | 13.977 | 6.10 | 7.14 | 9.4 | 10.6 | 2.549 | 6.82 |

TABLE 9

As-High Pressure CDC Compacted (@ 150 tsi) Properties of Core Steel (Base Material*) Mechanical Test Samples with varying additive levels, and Trial Hollow Slug (with inner core steel with some additive and outer magnetic ring (Pressed together as one unit).

| Sample #: | Description: | Green Density ($g/cm^3$) | Mass: (g) | ID/ width (in) | OD/ length (in) | Height (in) | Die Geometry: | Change from die ID/ width (%) | Change from die OD/ length (%) | Load (tsi) |
|---|---|---|---|---|---|---|---|---|---|---|
| 2782 | MQLP-B //1000C Pure Iron- layered | 7.3950 | 29.811 | 0.3480 | 3.5420 | 0.2460 | Tensile | 1.46 | 0.37 | 157.4 |
| 2783 | Base material* | 7.6044 | 31.008 | 0.3455 | 3.5325 | 0.2488 | Tensile | 0.73 | 0.10 | 153.6 |
| 2784 | Base material + medium additive | 7.2039 | 31.008 | 0.3465 | 3.5380 | 0.2627 | Tensile | 1.02 | 0.26 | 142.5 |
| 2785 | Base material + medium additive | 7.2193 | 31.015 | 0.3460 | 3.5360 | 0.2622 | Tensile | 0.87 | 0.20 | 149.8 |
| 2786 | Base material + medium additive | 7.3108 | 30.989 | 0.3450 | 3.5380 | 0.2587 | Tensile | 0.58 | 0.26 | 142.3 |
| 2787 | Base material + low additive | 7.4810 | 30.975 | 0.3445 | 3.5350 | 0.2527 | Tensile | 0.44 | 0.17 | 151.8 |
| 2788 | Base material + low additive | 7.4762 | 30.996 | 0.3450 | 3.5375 | 0.2530 | Tensile | 0.58 | 0.24 | 141.8 |
| 2789 | Base material + low additive | 7.4723 | 32.000 | 0.3450 | 3.5375 | 0.2613 | Tensile | 0.58 | 0.24 | 148.9 |
| 2790 | Base material + high additive | 7.0953 | 29.998 | 0.3460 | 3.5400 | 0.2580 | Tensile | 0.87 | 0.31 | 142.1 |
| 2791 | Base material + high additive | 7.0433 | 30.009 | 0.3470 | 3.5400 | 0.2600 | Tensile | 1.17 | 0.31 | 146.2 |
| 2792 | Base material + high additive | 7.1263 | 29.993 | 0.3460 | 3.5390 | 0.2568 | Tensile | 0.87 | 0.28 | 143.0 |
| W81 | Base material + low additive//MQLP-B | 6.8597 | 141.964 | 0.4750 | 1.3662 | 0.9800 | 1.35 Cyl | 0.00 | 1.20 | 135.4 |

TABLE 10

As-Pressed CDC Higher Pressure Compacted Net Shape Formed Thin Walled Bonded Neo Rings (300 Ton CDC Press)

| Sample #: | Green Density ($g/cm^3$) | Mass: (g) | ID* (in) | OD* (in) | Wall Thickness | Height (in) | Change from die ID (%) | Change from die OD (%) | Aspect Ratio (Height/ Wall Thick) |
|---|---|---|---|---|---|---|---|---|---|
| 3083* | 5.9652 | 23.716 | 1.2020 | 1.3200 | 0.059 | 1.0380 | 0.38 | 0.59 | 17.59 |
| 3084 | 6.1217 | 23.947 | 1.2030 | 1.3210 | 0.059 | 1.0205 | 0.47 | 0.66 | 17.30 |
| 3085 | 6.2934 | 23.933 | 1.2040 | 1.3218 | 0.0589 | 0.9935 | 0.55 | 0.72 | 16.87 |
| 3087 | 6.2630 | 23.986 | 1.2040 | 1.3213 | 0.05865 | 1.0050 | 0.55 | 0.68 | 17.14 |
| 3088 | 6.2634 | 23.966 | 1.2030 | 1.3213 | 0.05915 | 0.9960 | 0.47 | 0.68 | 16.85 |
| 3089 | 6.2703 | 23.973 | 1.2033 | 1.3215 | 0.0591 | 0.9950 | 0.49 | 0.70 | 16.83 |

TABLE 10-continued

As-Pressed CDC Higher Pressure Compacted Net Shape Formed Thin Walled Bonded Neo Rings (300 Ton CDC Press)

| Sample #: | Green Density (g/cm$^3$) | Mass: (g) | ID* (in) | OD* (in) | Wall Thickness | Height (in) | Change from die ID (%) | Change from die OD (%) | Aspect Ratio (Height/ Wall Thick) |
|---|---|---|---|---|---|---|---|---|---|
| 3090 | 6.2401 | 23.987 | 1.2030 | 1.3220 | 0.0595 | 0.9940 | 0.47 | 0.74 | 16.71 |
| 3107 | 6.2951 | 24.009 | 1.2035 | 1.3223 | 0.0594 | 0.9880 | 0.51 | 0.76 | 16.64 |

*#3083-CDC compacted Thin Walled Ring sample (MQLP-B powder with 1% Resin) at 95 tsi

3084- CDC compacted Thin Walled Ring sample (MQEP-B+powder with 1% Resin) at ~150 tsi All the other Thin Walled Ring samples (#3085 to #3107) were done ~140-150 tsi range using MQLP-B Powder with 1% Resin Average measurements were taken for Internal Diameter (ID) and Outer Diameter (OD) dimensions.

Note:

**The CDC higher pressure compacted samples using Higher Performance Magnet (HPM Alloy Series Developed at UTRON Using Base Alloy Mixes with Suitable Epoxy Resin % at UTRON Kinetics, revealed significant magnetic property improvements of Br (higher remnance or induction) and Hci (higher intrinsic coercive force, and as required to reduce the magnetic induction to zero). This epoxy resin we used was blended in varying percentages with the baseline powders provided by the magnet baseline powder supplier.

Based on the unique magnetic property improvement results, one of the suggested powder composition with 1% resin was recommended by the Principal Scientist to the baseline powder supplier to provide MQLP-B+together with ~1% resin weight%, to demonstrate the proof of concept using CDC higher pressure compaction. Epoxy resins typically have curing temperatures of 350 degF; Max service Temp of 350 degF; Tensile Strength of 8-13 ksi, Elongation of 3-7% and in bonded neo magnets , the properties depend on the % of such epoxy resins.

**Additional rings were fabricated to assure the reproducibility of one of the innovative net shape manufacturing of thin walled (e.g., wall thickness of ~0.059 inches) rings and also evaluate the properties of statistically acceptable #of rings; CDC Bonded Neo Magnet Sample # 3091-3115 as of filing this provisional patent application.

While the invention has been described with reference to specific embodiments, modifications and variations of the invention may be constructed without departing from the scope of the invention, which is defined in the following claims.

We claim:

1. Composition comprising a compact thin walled rare earth magnet made of a composite powder and 1% by weight of epoxy resin precompressed at about 20 tons per square inch and compressed at 150 tons per square inch to a density greater than or equal to 6.1 grams/cm$^3$ and heat treated to a curing temperature of the resin, wherein the composite powder comprises a samarium—cobalt alloy powder, wherein powder comprises about 85-95% by weight 4,4'-Isopropylidenediphenol-epichlorohydrin polymer and about 1-10% by weight cyanoguanidine.

2. The composition of claim 1, wherein the magnet is coated with zinc, nickel or gold plating.

3. The composition of claim 1, wherein the magnet has a ring shape and has a length to wall thickness aspect ratio of about 16.7 or more and a density of about 6.10 g/cm$^3$ or more.

* * * * *